US011497665B2

(12) United States Patent
Matters et al.

(10) Patent No.: US 11,497,665 B2
(45) Date of Patent: Nov. 15, 2022

(54) MOBILE PATIENT SUPPORT CHAIR

(71) Applicant: TOBRUK ENGINEERING PTY LTD, Eastwood (AU)

(72) Inventors: Brenton George Matters, Eastwood (AU); Alan Royce, Eastwood (AU); Jake Nathaniel Matters, Eastwood (AU); Scott Brenton Matters, Eastwood (AU)

(73) Assignee: TOBRUK ENGINEERING PTY LTD, Eastwood (AU)

( * ) Notice: Subject to any disclaimer, the term of this patent is extended or adjusted under 35 U.S.C. 154(b) by 188 days.

(21) Appl. No.: 16/954,610

(22) PCT Filed: Dec. 10, 2018

(86) PCT No.: PCT/AU2018/000251
§ 371 (c)(1),
(2) Date: Jun. 17, 2020

(87) PCT Pub. No.: WO2019/119014
PCT Pub. Date: Jun. 27, 2019

(65) Prior Publication Data

US 2020/0330297 A1 Oct. 22, 2020

(30) Foreign Application Priority Data

Dec. 18, 2017 (AU) ..... 2017905052

(51) Int. Cl.
*A61G 5/10* (2006.01)
*A61G 7/10* (2006.01)
*A61G 5/12* (2006.01)

(52) U.S. Cl.
CPC ..... *A61G 5/104* (2013.01); *A61G 5/1075* (2013.01); *A61G 5/1091* (2016.11); (Continued)

(58) Field of Classification Search
None
See application file for complete search history.

(56) References Cited

U.S. PATENT DOCUMENTS 3,964,786 A 6/1976 Mashuda
5,020,171 A 6/1991 DiMatteo et al.
(Continued)

FOREIGN PATENT DOCUMENTS

EP 1550427 A1 * 7/2005 ..... A61G 1/0225
GB 2293797 A * 4/1996 ..... A61G 5/006
(Continued)

OTHER PUBLICATIONS

International Search Report and Written Opinion for International (PCT) Patent Application No. PCT/AU2018/000251, dated Feb. 15, 2019, 9 pages.

*Primary Examiner* — Sarah B McPartlin
(74) *Attorney, Agent, or Firm* — Sheridan Ross P.C.

(57) ABSTRACT

A mobile patient support chair to assist in bathing of a patient by a carer with little or no upper body strength comprises a chair pivotally mounted in a support frame comprised of four legs each ending in a wheel. The chair frame comprises groups of support panels which can be locked in support positions and rotated through 90 degrees to provide access to the patient's legs, buttocks and back. Additionally the chair is balanced to allow easy rotation into a fully backwards lying position, and a fully forward lying position. In the fully forward lying position flexible retaining strips are placed across the patient to retain them in place. Additionally the wheels may be step-climbing wheels to assist in climbing small steps found in bathroom entrances and shower cubicles.

17 Claims, 26 Drawing Sheets

(52) U.S. Cl.
CPC ..... *A61G 7/1059* (2013.01); *A61G 5/1045* (2016.11); *A61G 5/1048* (2016.11); *A61G 5/121* (2016.11); *A61G 5/125* (2016.11); *A61G 5/128* (2016.11); *A61G 7/1046* (2013.01)

(56) References Cited

U.S. PATENT DOCUMENTS

| | | | | |
|---|---|---|---|---|
| 5,103,512 | A | 4/1992 | DiMatteo et al. | |
| 5,366,036 | A | 11/1994 | Perry | |
| 5,366,277 | A | 11/1994 | Tremblay | |
| 5,447,356 | A * | 9/1995 | Snijders ..... | A47C 7/405 297/284.3 |
| 8,690,178 | B2 | 4/2014 | Griswold et al. | |
| 9,333,131 | B2 | 4/2016 | Griswold et al. | |
| 10,322,048 | B2 | 5/2019 | Cooper et al. | |
| 2005/0138731 | A1 | 6/2005 | Failor et al. | |

FOREIGN PATENT DOCUMENTS

| | | |
|---|---|---|
| KR | 101495856 | 2/2015 |
| TW | 201507714 | 3/2015 |
| WO | WO 1993/017649 | 9/1993 |

* cited by examiner

DETAIL H

Ground Level
SECTION C-C

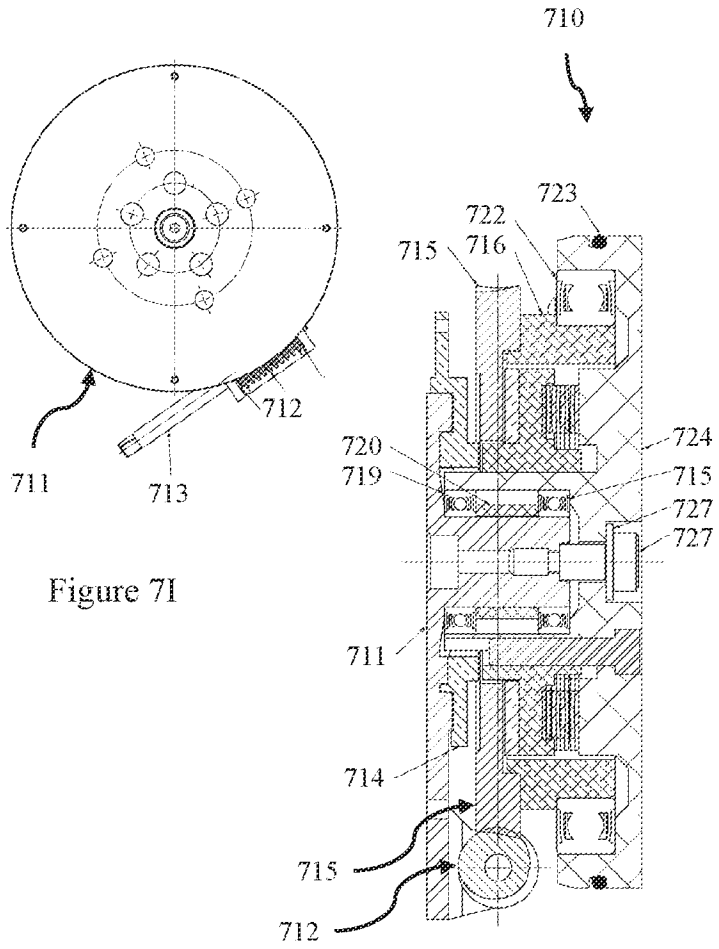
SECTION A-A
(ROTATED)
Figure 7K
Figure 7I
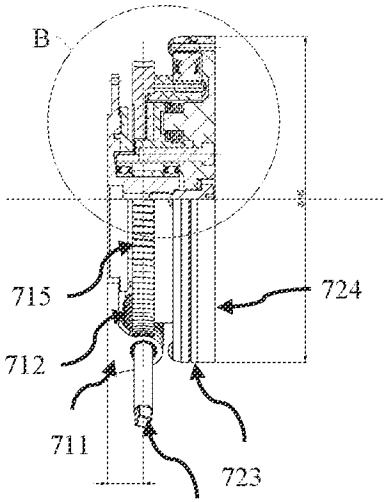
Figure 7H
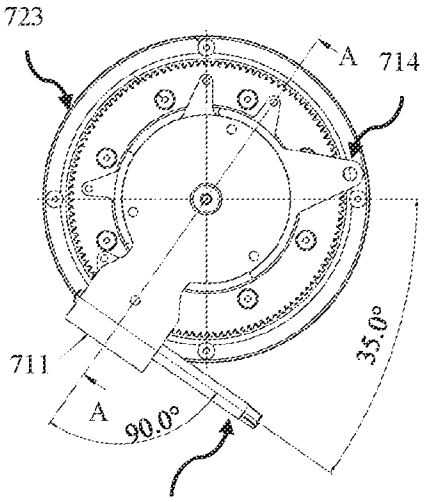
Figure 7G
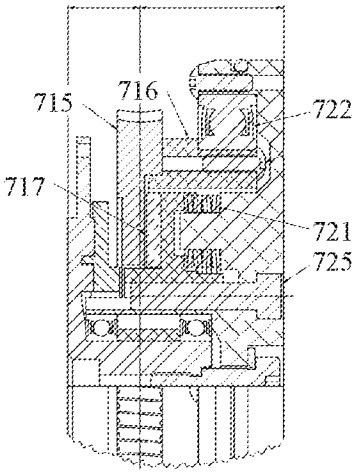
DETAIL B
Figure 7J Section A–A

MOBILE PATIENT SUPPORT CHAIR

CROSS REFERENCE TO RELATED APPLICATIONS

This application is a national stage application under 35 U.S.C. 371 and claims the benefit of PCT Application No. PCT/AU2018/000251 having an international filing date of 10 Dec. 2018, which designated the United States, which PCT application claimed the benefit of Australian Patent Application No. 2017905052 filed 18 Dec. 2017, the disclosures of each of which are incorporated herein by reference in their entireties.

TECHNICAL FIELD

The present disclosure relates to patient support chairs. In a particular form the present disclosure relates to mobile chair for supporting a patient during activities of daily living.

BACKGROUND

Many people wish to independently grow old in their homes. However as they age their support requirements often increase, particularly around activities of daily-living such as washing. Often a patient will need to be assisted in moving to a bathroom and into a shower cubicle, and then once in the shower cubicle, they will need to be washed by their carer. Next, in order to satisfactorily wash the patient, the carer needs full access to the patient's body and in particular areas that support their weight such as buttocks, back, and the rear of their legs. The importance of these requirements is often heightened as many elderly patients suffer from incontinence and/or loose bowels. However in many cases their primary carer is their aged partner who will often have low or no upper body strength, and thus will have difficulty in assisting with such activities.

Current independent living technologies such as wheel chairs and shower chairs are thus difficult for such carers to use and require the carer to assist in transfers. Also many bathrooms and shower cubicles in homes feature small steps or lips which must be safely traversed to access a shower cubicle. Hoists and support frames can also be used to lift or assist the patient into a standing position, but this requires the carer to perform the transfer and monitor the patient to ensure they are fully supported and cannot fall. However many elderly carers lack sufficient strength capabilities to properly assist and so these devices tend to be large, expensive and complicated. Further many shower chairs provide limited access to support areas and in many cases the carer must get down on their hands and knees to fully access the patient's body which may be difficult for older carers. Additionally a shower chair must be impervious to water ingress and resistant to harsh cleaning agents such as bleaches, and made of materials that resist bacterial growth.

There is thus a need to provide an improved patient support chair for assisting in activities of daily living, or to at least provide a useful alternative to existing devices.

SUMMARY

According to a first aspect, there is provided a mobile patient support chair comprising:

a support frame comprising at least four legs each ending in at least one wheel;

a lockable pivot mounting arrangement;

a chair pivotally mounted to the support frame by the lockable pivot mounting arrangement, the chair having an inner side for receiving a patient and an outer side, and the lockable pivot mounting arrangement is configured to lock the chair in a sitting position and a plurality of rotated positions, the plurality of rotated positions comprising at least one forward position rotated with respect to the sitting position, and at least one rearward position rotated with respect to the sitting position, the chair comprising:

a chair frame defining the perimeter of a back portion, a seat portion and a leg portion and;

two arm supports extending inwards from the seat portion of the chair frame;

a head support mounted to the back portion of the chair frame and extending away from the chair frame; and a plurality of support panels mounted to the chair frame, each moveable between a support position and an access position, and lockable at least in the support position, wherein in the support position the support panel supports the patient's body when sitting in the chair, and in the access position the support panel is in a position to provide access to the patient's body adjacent the inner side of the chair.

In one form the chair further comprises:

a plurality of flexible retaining portions removable or retractably attachable to the chair frame, and when attached each flexible retaining portion extends from a first side of the chair frame to a second opposing side of the chair frame for retaining a patient against the inner side of the chair as the chair is rotated and locked in the at least one a forward position or the at least one rearward position.

In one form, in the support position each of the plurality of support panels is located within a plane defined by either of the back portion, the seat portion, or the leg portion of the frame, or in a foot support position in a plane orthogonal to the plane of the leg portion.

In one form, the plurality of support panels are each pivotally mounted to chair frame, and are each rotatable through at least 90 degrees from the support position to the access position.

In one form, the chair further comprises a rotation assistance arrangement to control rotation of the chair about the support frame so that a carer is only required to guide the rotation of the chair to and from the sitting position to the rotated positions, and is not required to use upper body strength to drive the rotational movement.

In one form, the chair frame comprises a back frame defining the back portion, a seat frame defining the seat portion and a leg frame defining the leg portion. In a further form the chair is configured to allow the back frame to be rotated away from the back of the person or to be slid up from a back support position to a patient receiving position to allow transfer of a patient from a bed onto the seat through the space occupied by the back frame when in the back support position.

In one form, each leg of the support frame includes a step-climbing wheel apparatus comprising:

a wheel mounting arrangement comprising at least three wheels arranged in a fixed triangular geometry such that when on a flat surface at least one wheel is in contact with the flat surface and at least one wheel is in an elevated position to define a vertical separation distance;

a chair leg mounting arrangement to mount the wheel mounting arrangement to a chair leg;

a drive arrangement which engages the wheel mounting arrangement to assist the mobile patient support chair to climb a step with a height less than the vertical separation distance.

In one form, the external surfaces of the chair are constructed of corrosion resistant materials, and are sealed or constructed to prevent water ingress.

In one form, each of the panels in the back portion, seat portion and leg portion are separately removable, and replaceable with a solid support section to convert the chair to a day chair.

In one form, the lockable pivot mounting arrangement is a clutch arrangement which controls the friction between a first section attached to the support frame and a second section attached to the chair to control the relative motion of the chair with respect to the support frame to allow the chair to be held in any position between a maximum forward position and a maximum rearward position.

In one form, the first section is a fixed section and the second section is a rotating section or the first section is a rotating section and the second section is a fixed section, and the clutch arrangement comprises a friction plate held under pressure by a plurality of springs located between the fixed section and the rotating section to hold the fixed section and rotating section in a fixed relationship, and a cam arrangement is configured to compress the springs and release the friction pressure allow that rotating section to rotate with respect to the fixed section.

In one form, the cam arrangement is controlled by a foot pedal connected by a linkage arrangement passing through a leg of the chair.

In a further aspect, a mobile patient support system is provided comprising the mobile patient support chair using the cam arrangement and a transfer station, wherein the support frame comprises two rearward legs, each comprising a laterally extending locking pin, and one rearward leg comprising a coupling connected via a linkage to a worm gear arrangement configured to control the rotation of the rotating section, and the transfer station comprises a first docking assembly, a second docking assembly, and a controller, each of the first and second docking assemblies configured to receive and secure one of the laterally extending locking pins, wherein one of the first or second assembly comprises a planetary gear configured to engage and drive the coupling to control the rotation of the chair with respect to the frame.

According to a further aspect, there is provided a mobile patient support system comprising the mobile patient support chair of the first aspect and a transfer station, wherein the support frame comprises two rearward legs, each comprising a laterally extending locking pin, and the transfer station comprises a first docking assembly, a second docking assembly, and a controller, each of the first and second docking assemblies configured to receive and secure one of the laterally extending locking pins, wherein one of the first or second assembly comprises an actuator configured to engage with the lockable pivot mounting arrangement to control the rotation of the chair with respect to the frame to enable transfer of the patient into and out of the chair.

BRIEF DESCRIPTION OF DRAWINGS

Embodiments of the present disclosure will be discussed with reference to the accompanying drawings wherein:

FIG. 7G shows a leg side view of the clutch arrangement according to an embodiment;

FIG. 7H shows an end view of the clutch arrangement according to an embodiment;

FIG. 7I shows a chair side view according to an embodiment;

FIG. 7J shows detail B of FIG. 7H;

FIG. 7K shows a section view through section AA of FIG. 7G;

FIG. 8A show an isometric view of the transfer station according to an embodiment;

FIG. 8B shows a top view of the first transfer station according to an embodiment;

FIG. 8C shows a side view of the transfer station according to an embodiment; and FIG. 8D shows a rear view of the transfer station according to an embodiment.

In the following description, like reference characters designate like or corresponding parts throughout the figures.

DESCRIPTION OF EMBODIMENTS

Referring now to FIGS. 1A to 1L, there is shown an embodiment of a mobile patient support chair 1 in various views and configurations (or states). Embodiments of this system allow use by carers with little or no upper body strength, and allow full back of body access to a patient (2). For ease of discussion and understanding of the disclosure we will refer to the person using the chair as the "patient", but it will be understood that equivalent wording would be the user or the client of the system.

Figure 1A:
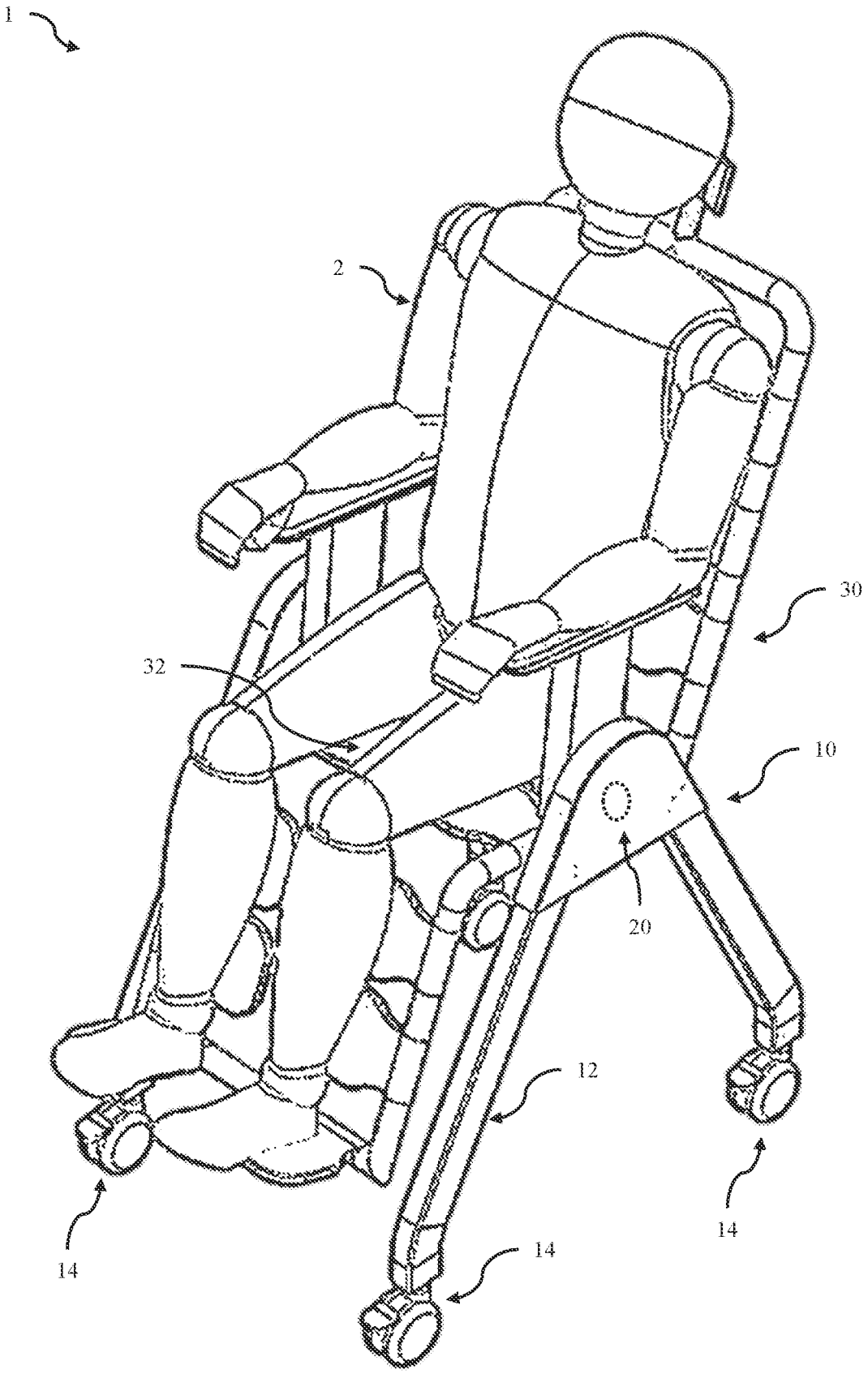
FIG. 1A is an first isometric view of a patient sitting in a mobile patient support chair according to an embodiment.
Figure 1B:
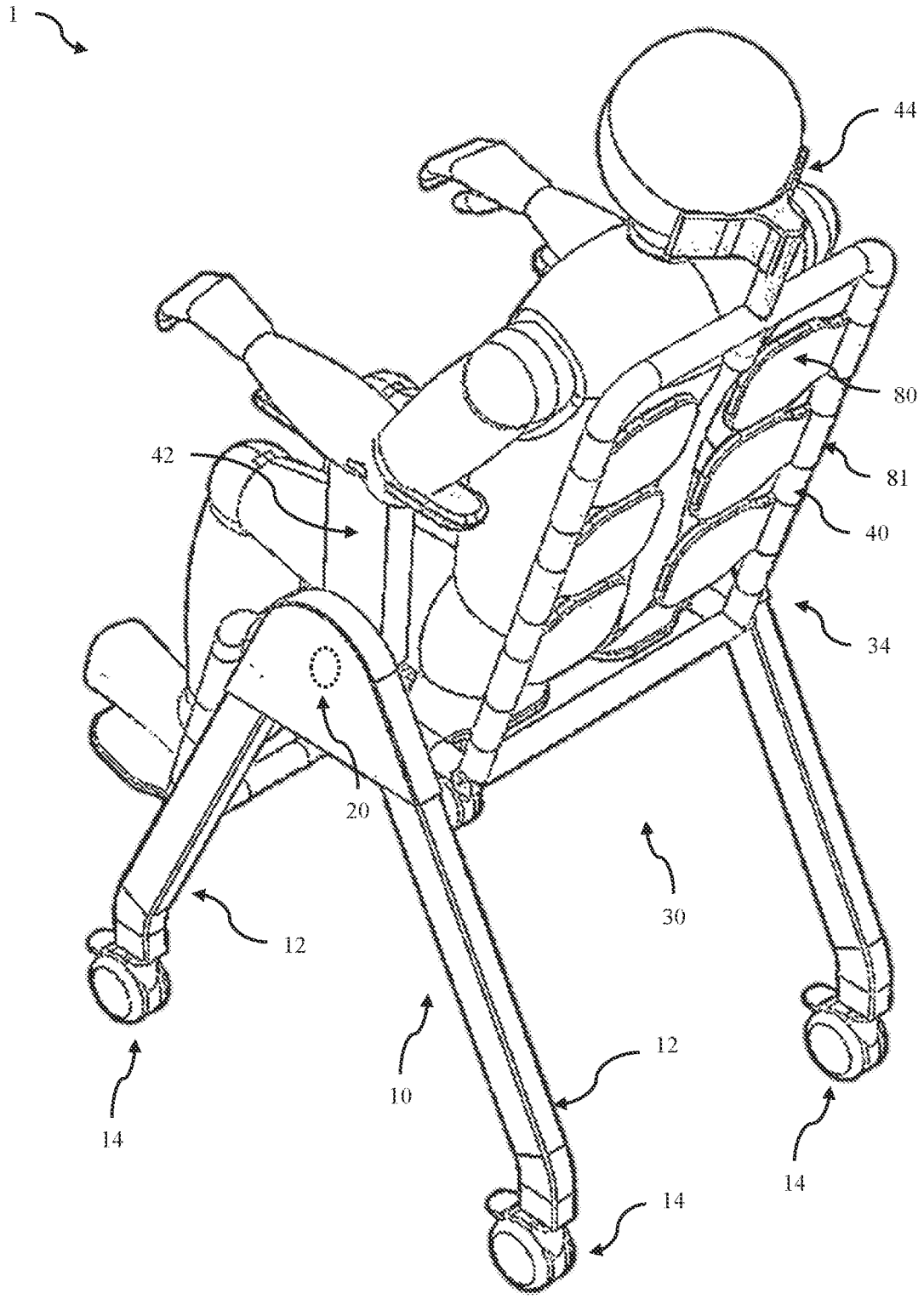
FIG. 1B is an second isometric view of the patient sitting in the mobile patient support chair shown in FIG. 1A.
Figure 1C:
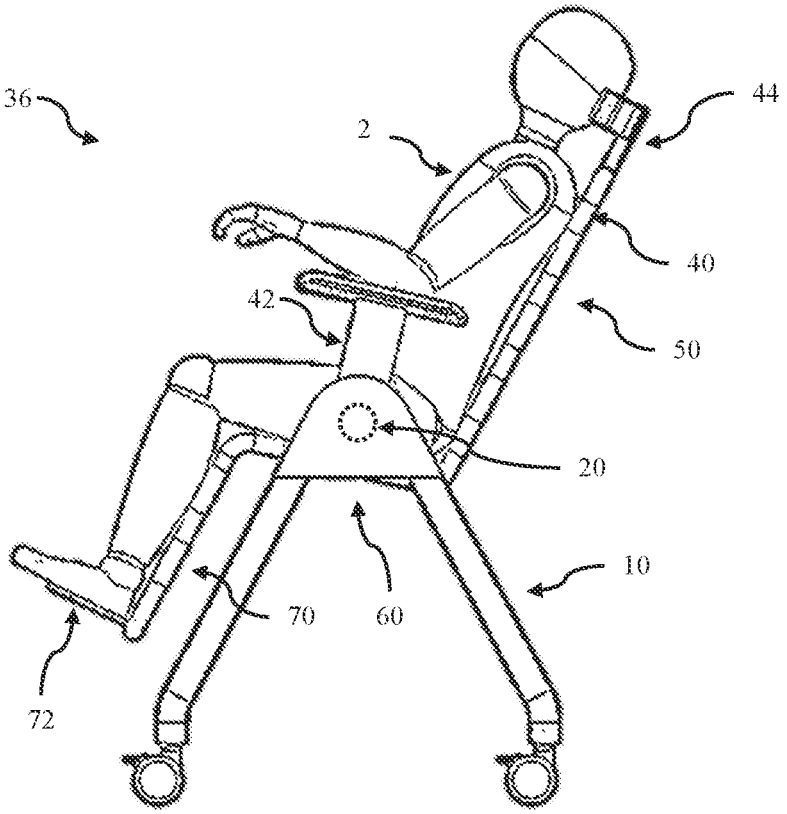
FIG. 1C is an side view of the patient sitting in the mobile patient support chair shown in FIG. 1A.
Figure 1D:
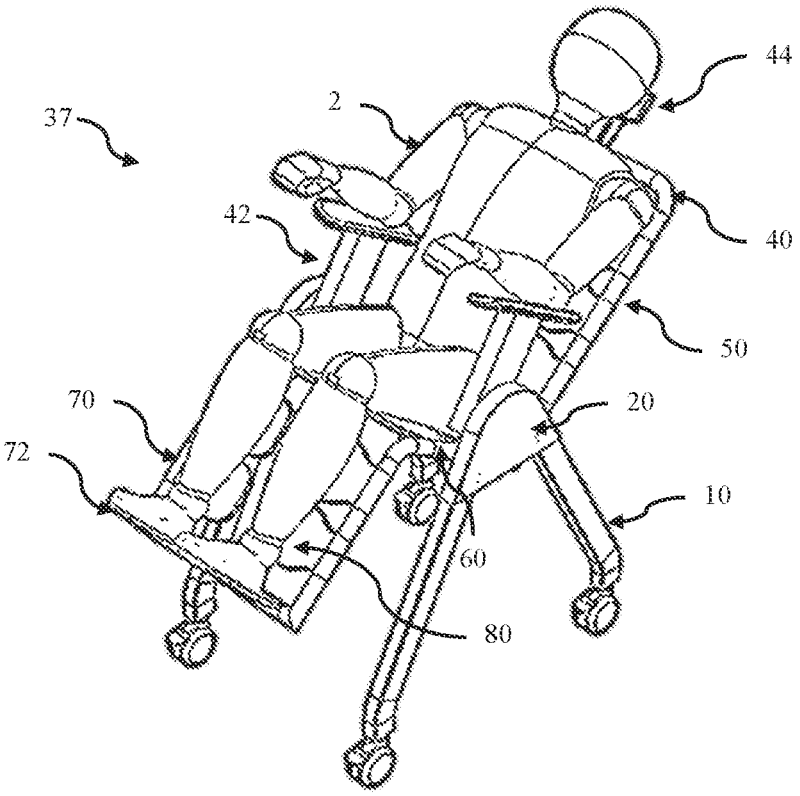
FIG. 1D is an isometric view of the patient sitting in a rearward rotated position in the mobile patient support chair shown in FIG. 1A.
Figure 1E:
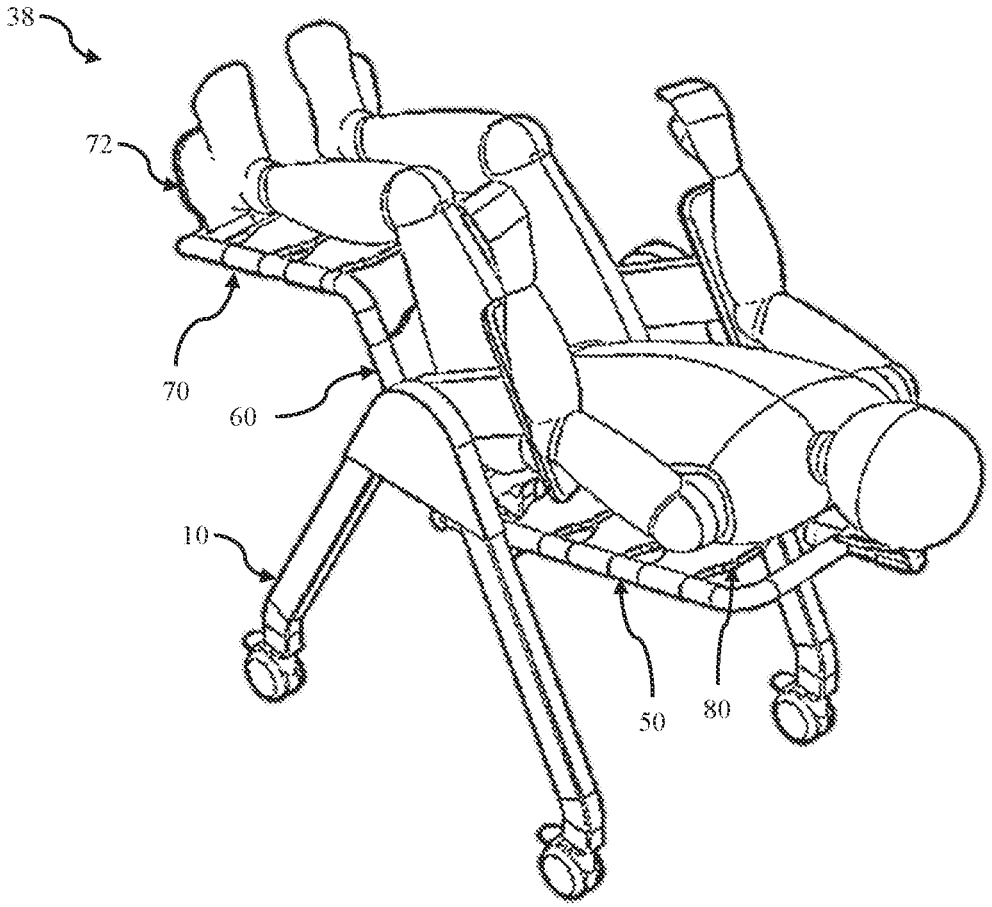
FIG. 1E is an isometric view of the patient sitting in a laid back rotated position in the mobile patient support chair shown in FIG. 1A.
Figure 1F:
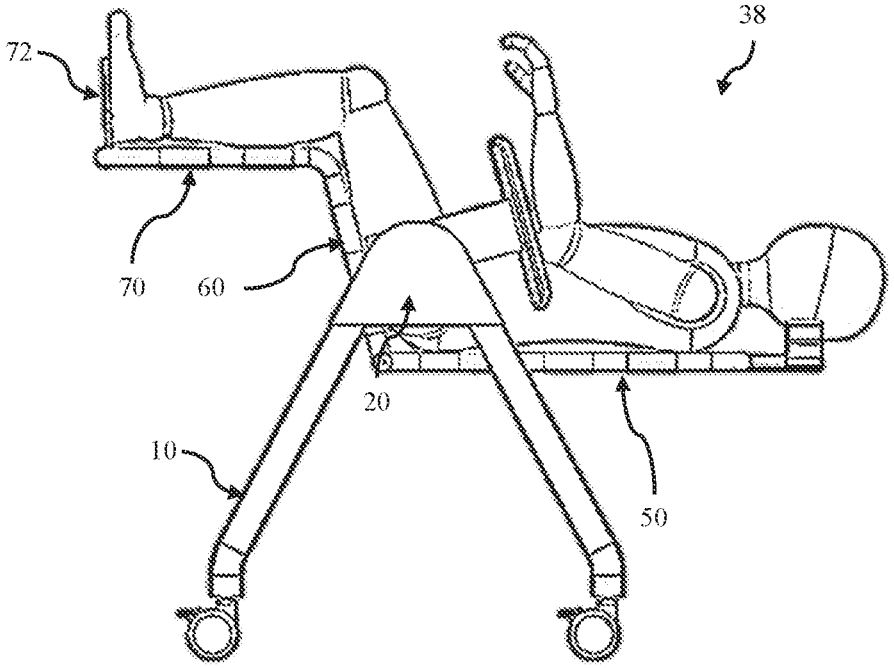
FIG. 1F is a side view of the patient sitting in the laid back rotated position in the mobile patient support chair shown in FIG. 1A.
Figure 1G:
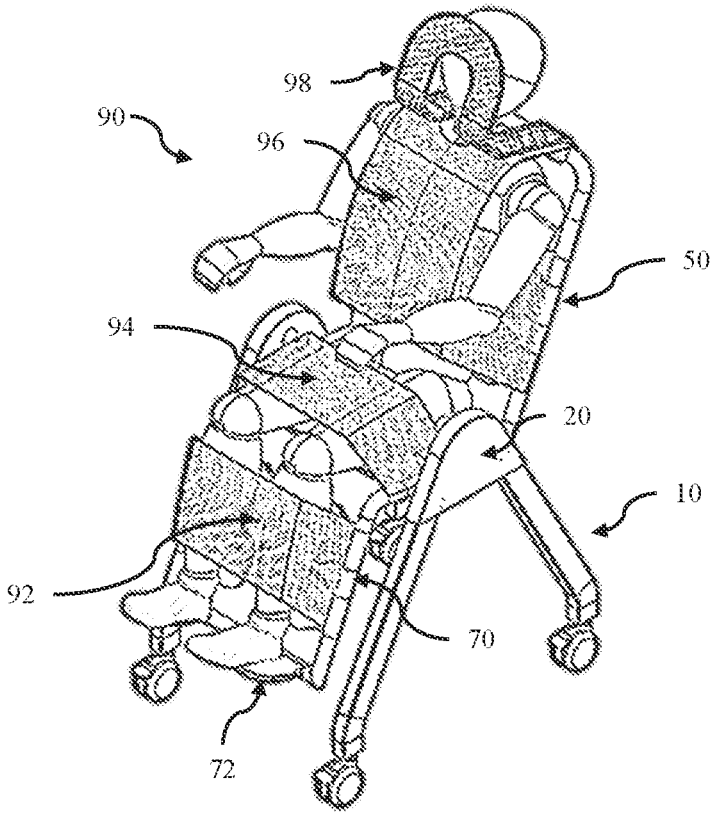
FIG. 1G is an isometric view of the patient sitting in the mobile patient support chair shown in FIG. 1A with a harness arrangement fitted.
Figure 1H:
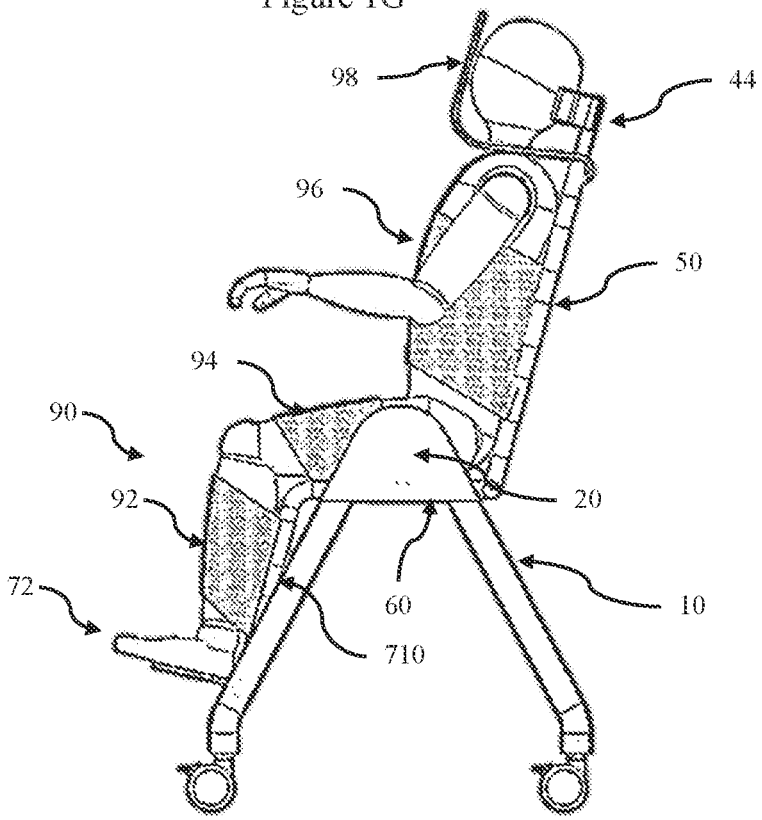
FIG. 1H is a side view of the patient sitting in the mobile patient support chair shown in FIG. 1A with the harness arrangement fitted.
Figure 1I:
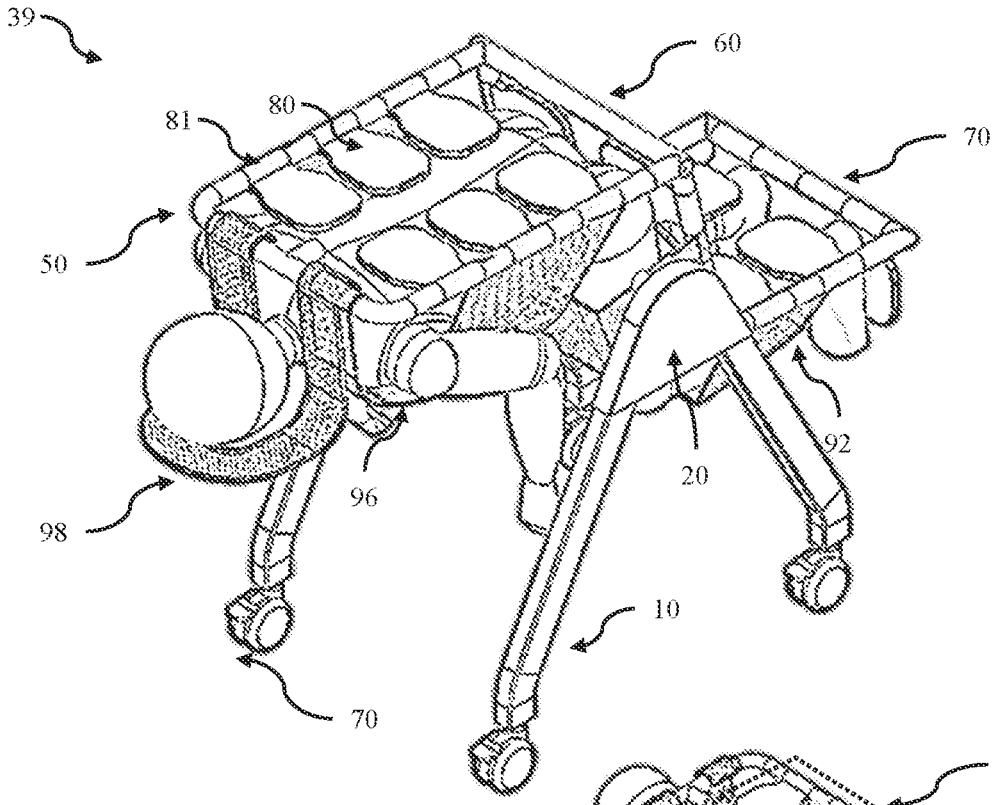
FIG. 1I is an isometric view of the patient sitting in a laid forward rotated position in the mobile patient support chair shown in FIG. 1A supported by the harness shown in FIG. 1G.

The chair 1 comprises a support frame (10) comprising at least four legs (12) each ending in a least one wheel (14), and a lockable pivot mounting arrangement (20). A chair (30) is pivotally mounted to the support frame (10) by the lockable pivot mounting arrangement (20) and has an inner side (32) for receiving a patient (2) and an outer side (34). The lockable pivot mounting arrangement (20) is configured to lock of the chair in a sitting position and a plurality of rotated positions including forward and rearward positions. These may be in preconfigured locations, or in any position between a maximum forward and a maximum rearward position. FIGS. 1A, 1B, 1C, 1G, and 1H show a sitting position (36), FIG. 1D shows a rearward reclined position (37), FIGS. 1E and 1F show a lying rearward position (38), and FIGS. 1I, 1J, 1K, 1L, 1M show a lying forward position (39), all rotated with respect to the sitting position (36).

Figure 6A:
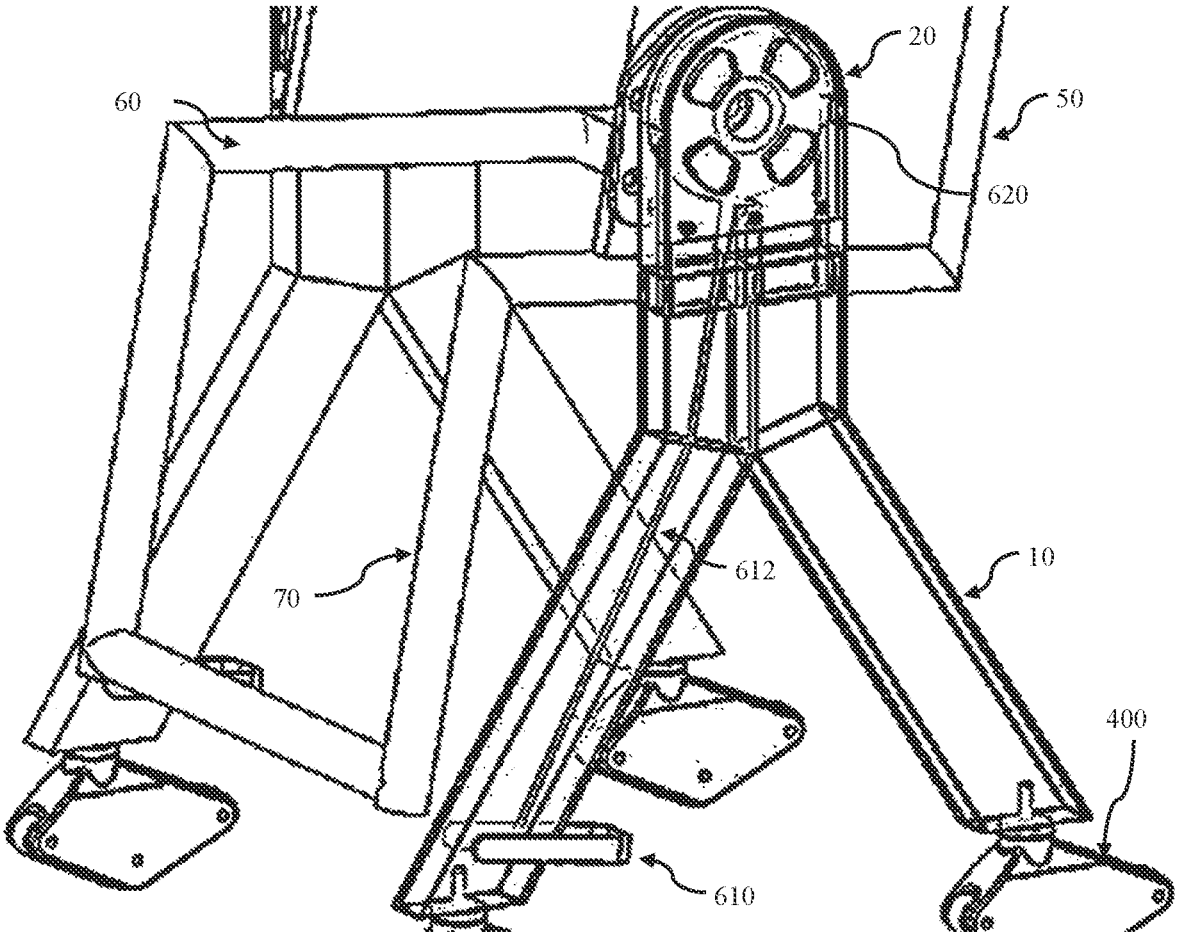
FIG. 6A is an isometric view of the lockable pivot mounting arrangement according to an embodiment.
Figure 6B:
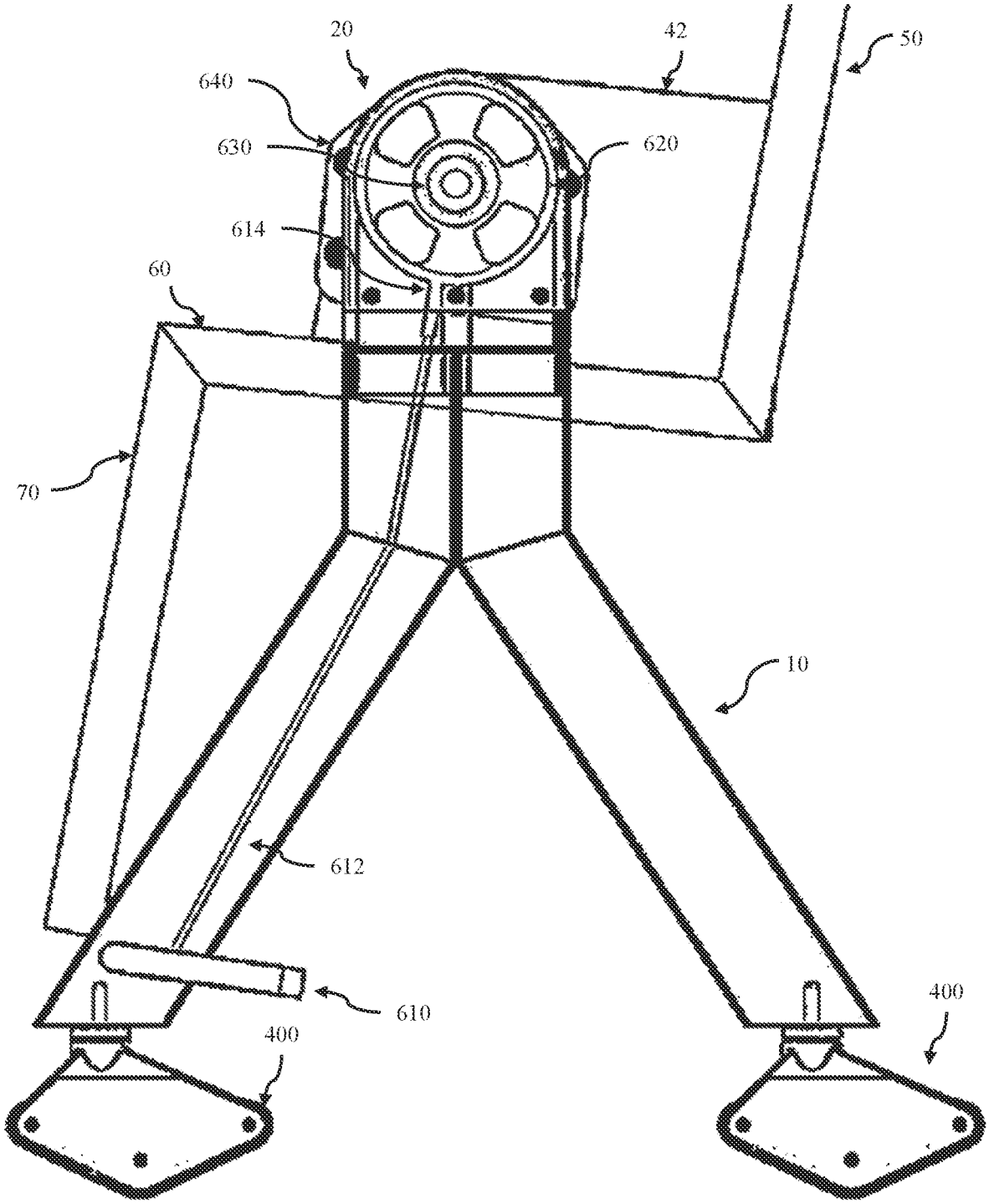
FIG. 6B is a side view of the lockable pivot mounting arrangement of FIG. 6A.
Figure 6C:
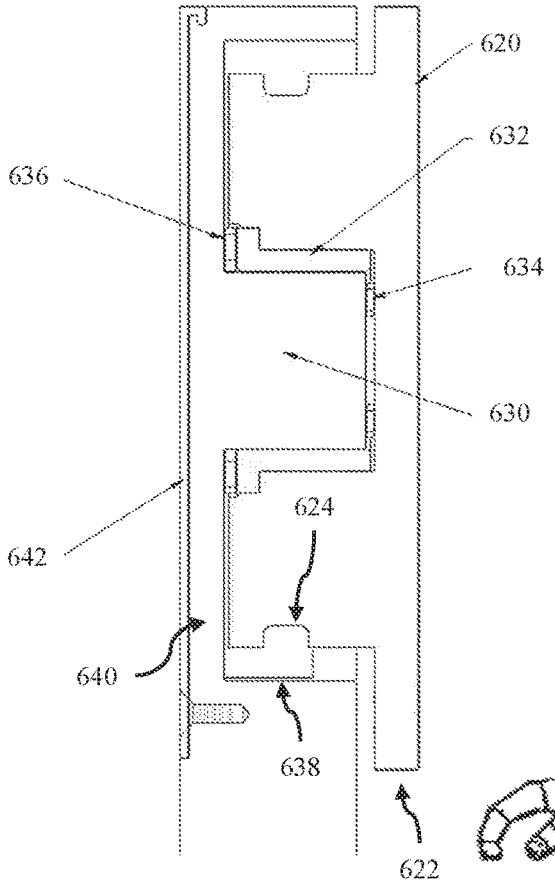
FIG. 6C is a sectional view of a cylindrical lock in the lockable pivot mounting arrangement of FIG. 6A.
Figure 6D:
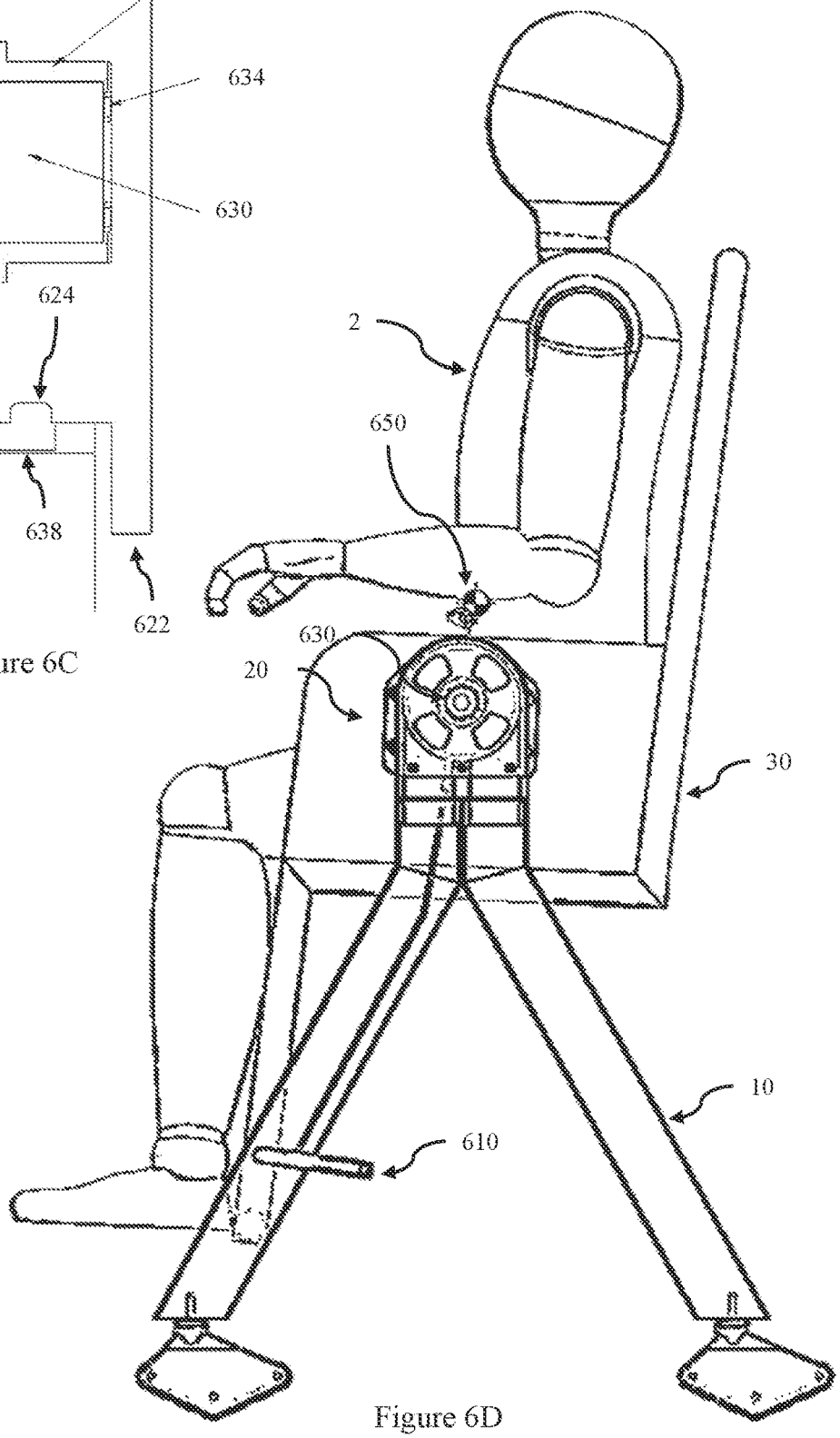
FIG. 6D is a side view of a patient sitting in the chair showing the lockable pivot mounting arrangement according to an embodiment.

In one embodiment the lockable pivot mounting arrangement 20 is multi positional held in place by a compression spring, the position points are incorporated in the rotating section of the rotation support. FIGS. 6A and 6B are an isometric and side view of the pivoting lock arrangement, and FIG. 6C is a sectional view of a cylindrical lock 620 in the lockable pivot mounting arrangement 20 according to an embodiment. The cylindrical lock 620 comprises a cylindrical piece with a flanged rim 622 with apertures distributed around the periphery for receiving one or more locking pins, each of which is connected to a lever 610 by cable connection 612. The cylindrical lock 620 is pivotably mounted on an axial support shaft 630 with a bush 532, needle bearings 632, 634, and a guide rim 638 which projects into a matching groove 624 of the cylindrical lock 620. The pivot shaft 630 is connected to a pivot mounting plate 640 on the side of the arm support 42. When locked the one or more locking pin are inserted (or engaged) in the peripheral apertures and acts as stops to prevent rotation of the chair 30 with respect to the support frame 10. When the lever 610 is engaged the lock pins 614 are retracted from the apertures and thus allow the chair to rotate about pivot 630. When the lever is released the lock pins, which are spring loaded, will engage with the next lock position (next aperture) in lock 620 to lock the chair in the current orientation. FIG. 6D is a side view of a patient 2 sitting in the chair 30 showing the lockable pivot mounting arrangement 20 according to an embodiment. To assist with pivotal rotation of the chair when unlocked, the centre of mass of the chair and patient 650 is slightly offset from the pivot shaft 630.

Figures 7A, 7B, 7C, 7D:
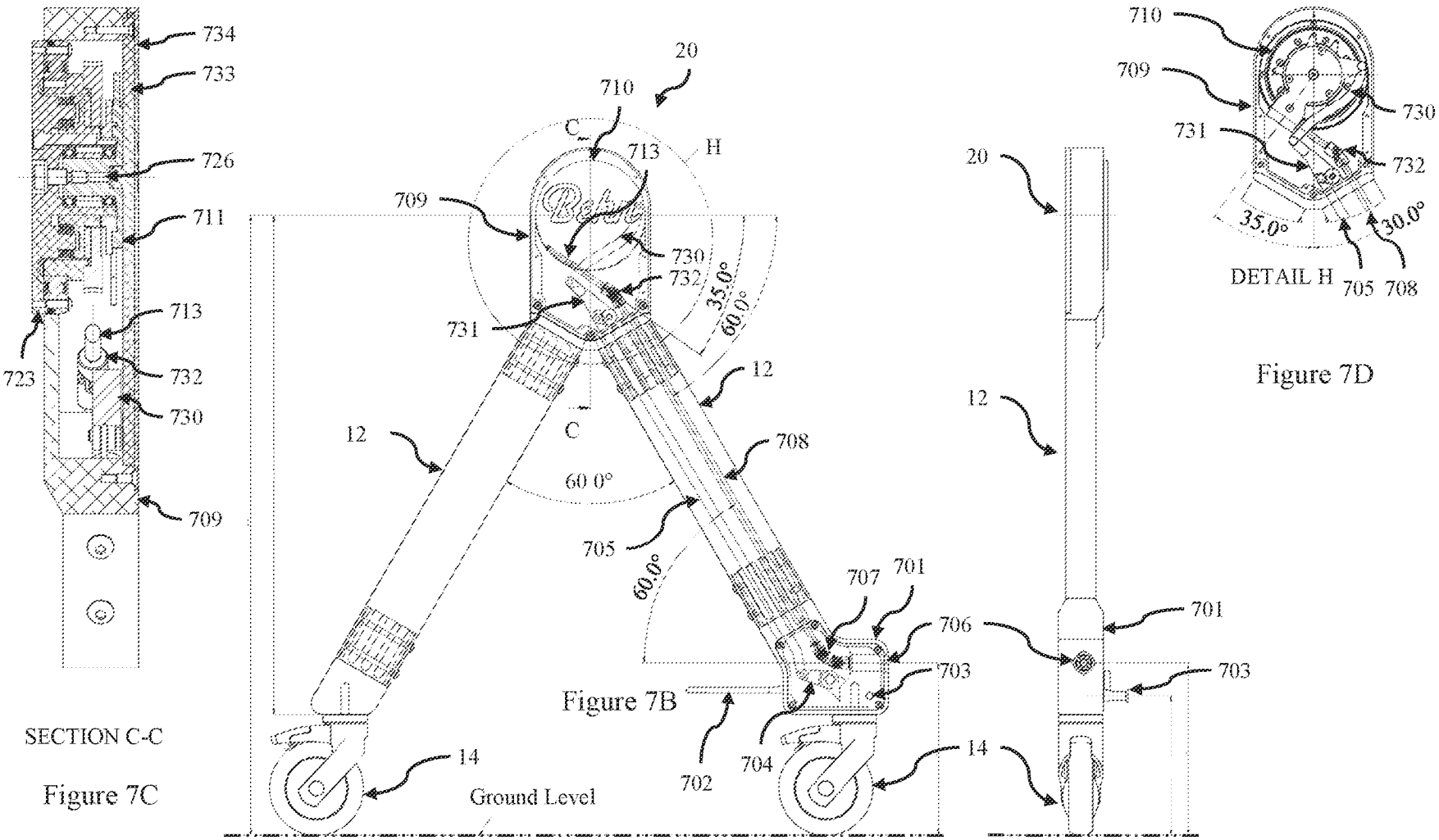
FIG. 7A is side view of the legs, wheels, and lockable pivot mounting arrangement according to an embodiment.
FIG. 7B is an end view of the legs, wheels, and lockable pivot mounting arrangement according to an embodiment.
FIG. 7C shows a sectional view CC through lockable pivot mounting arrangement according to an embodiment.
FIG. 7D shows detail H of FIG. 7A.
Figure 7E:
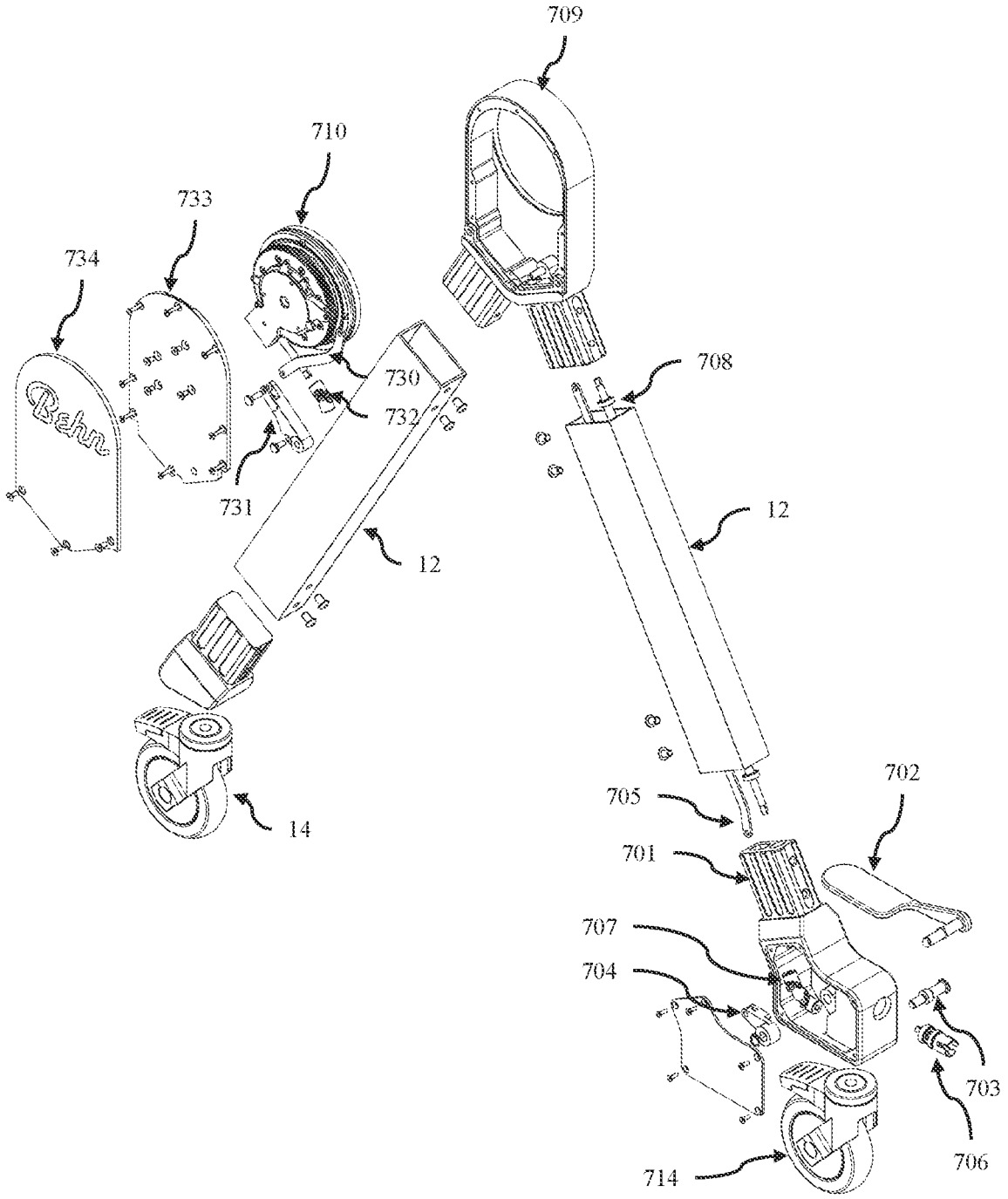
FIG. 7E is an exploded view of FIG. 7A.
Figure 7F:
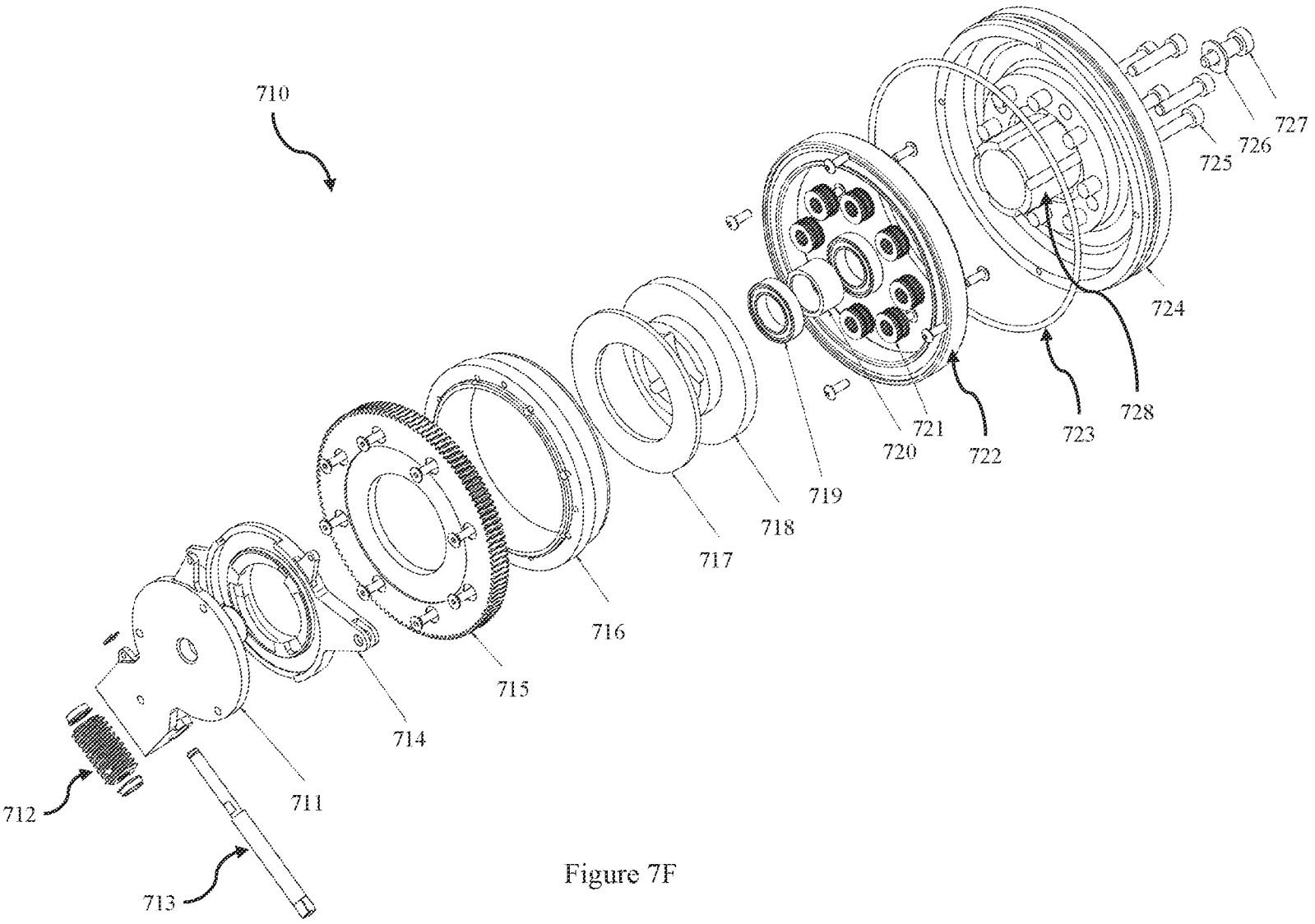
FIG. 7F is an exploded view of the clutch arrangement according to an embodiment

FIGS. 7A to 7K show another embodiment of the lockable pivot mounting arrangement 20 using a clutch arrangement 710. FIGS. 7A and 7B show a side and end view of the legs (12), wheels (14) and lockable pivot mounting arrangement 20, and FIG. 7F shows an exploded side view. FIG. 7C shows a sectional view CC through lockable pivot mounting arrangement 20, and FIG. 7D shows detail H of FIG. 7A. FIG. 7E is an exploded view of FIG. 7A. FIG. 7F is an exploded view of the clutch arrangement (710). FIG. 7G shows a leg side view of the clutch arrangement (710) and FIG. 7K shows a section view through section AA of FIG. 7G. FIG. 7I shows a chair side view. FIG. 7H shows an end view of the clutch arrangement 710 with FIG. 7J showing detail B of FIG. 7H. This arrangement allows control of the chair at any angle between a maximum forward position and a maximum rearward position.

In this embodiment the system has a fixed section (housing 709, cover 734, mounting plate 733, clutch mounting plate 711, and clutch 714) attached to the leg of the chair and a rotating section (clutch chair mounting flange 724) attached to the chair body. The two sections are connected by a fixed shaft (shaft 728 on clutch chair mounting flange 724) on the chair and a bearing arrangement in the leg (bearing sleeve 719 and bearing spacer 720 on the shaft, and bearing 722 and outer bearing sleeve 716 which is connected to the clutch worm drive gear 715). In this embodiment the bearing is a shielded single row ball bearing. Between the two sections there is a friction plate (718) engaging friction disk (717), the friction plate is held under pressure by a series of springs (721) maintaining the degree of friction required to hold the two sections together stopping any independent movement. The springs (721) are located on projections extending from the chair mounting flange (724). When the chair is required to rotate independently to the leg 12 the springs (721) are compressed by way of a foot pedal (702) and linkage that rotates a cam arrangement (714) compressing the springs (721) releasing the friction pressure applied to the friction plate (718), thus allowing the chair to rotate. As the pressure on the pedal (102) is released pressure of the springs (721) is applied to the friction material and locks the two sections together again. The linkage comprises a first lever (704) in the foot housing (701) connected to foot pedal (702), which is in turn connected to a clutch release link (706) that pass through the rear leg (12) where it connects to second lever (731) located in the housing 709. The second lever (731) is connected to clutch release link 730 fastened to a radial projection on the cam arrangement (714). Additionally, rotation of the chair can also be externally driven via worm drive gear 715 and worm drive 712. The worm drive 712 is connected to leg drive shaft 708 via a universal joint 732. The leg drive shaft passes through rear leg 12 and the distal end of the leg drive shaft 708 is connected to a double universal joint 707, connected to chair drive coupler 706 located in the wheel mount 701. This comprises a slot allowing it to be driven by planetary gear forming part of the transfer (or docking station) which is discussed below.

The 30 chair (30) comprises a chair frame (40) defining the perimeter of a back portion, a seat portion, and a leg portion, and two arm supports (42) extending inwards from the seat portion (60) of the chair frame. A head support (44) mounted to the upper cross member of back portion 50 of the chair frame (50) and extending away from the chair frame (40). The chair frame (40) may be an integral frame, or as shown in this embodiment the chair frame (40) may be a multi component frame comprised of a back frame 50 defining the back portion, a seat frame (60) defining the seat portion and a leg frame (70) defining the leg portion.

A plurality of support panels (80) are mounted to the chair frame (40). Each is moveable between a support position (82) and an access position (84), and is lockable at least in the support position. Preferably it is also lockable in the access position (84). In the support position the support panel supports the patient's body when sitting in the chair, and in the access position the support panel is in a position to provide access to the patient's body adjacent the inner side of the chair (32).

In the support position each of the support panels (80) is located within a plane defined by either of the back portion, the seat portion or the leg portion of the frame. Additionally two support panels form a foot support position (72) in a plane orthogonal to the plane of the leg portion (70). In the access position (84) the support panel (80) is located outside of the respective back portion, seat portion, or leg portion of the frame. That is in the support position the support panels are substantially within the plane of the relevant back, seat or leg portion, and in the access position they rotate in the direction of the outer side (34) of the seat, for example to be orthogonal to the support position (84), or beyond 90° (eg to 180° or even more) to provide access to the patient (2). Angles of less than 90° can also be used, but are less desirable as they provide reduced access to the patient (2).

In this embodiment the support panels (80) are each pivotally mounted (81) to the chair frame, and are each rotatable through at 90° degrees from the support position to the access position, and are lockable in both the support (82) and access (84) positions. In other embodiments other non-pivot based mounting arrangements may be used, for example sliding mounts which allow the panels to be slid from a support location within the perimeter of the frame, to an access location external to the perimeter of the frame (both positions within the plane defined by the perimeter of the frame). In one embodiment, the locking system positively locks the support panels in the support position, and once locked cannot be released or moved until complete release of any load on the support. That is they can only be released and moved to the access position when the patient is rotated and lying in the forward access position (39) such that there is no load or weight on the support panel.

Figure 2A:
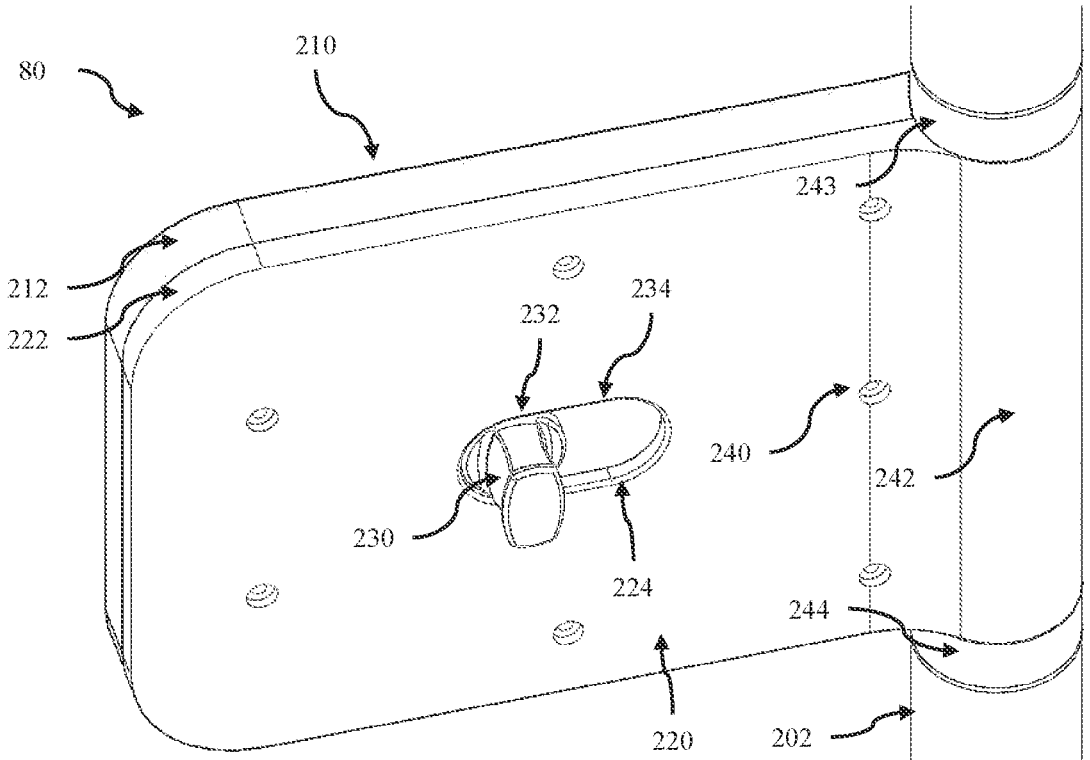
FIG. 2A is an isometric view of support panel pivotally attached to a frame element according to an embodiment.

FIGS. 2A to 2H illustrate an embodiment of a support panel (80) and the locking system. FIG. 2A is an isometric view of support panel (80) pivotally attached to a frame element (202) according to an embodiment. The support panel (or paddle) (80) is comprised of a two plates (212) and (222) which form the housing. The first plate (212) is located on the front or patient side (210) of the support panel and in use supports the patient and the second plate (222) is located on the rear side (220). The plates are pivotally mounted to the frame element (202) using a pivotal mounting arrangement (240) comprised of the first proximal end (241) of first plate and first proximal end (242) of second plate (222) (proximal with respect to the frame element 202). These proximal ends (241) and (242) are shaped or curved to enclose or wrap around the frame element (202). The two plates can be fastened to each other using screws or other fastening arrangements such as clipping arrangements. A seal (for example a resilient rubber or plastic/polymer material) can be included to prevent ingress of water and cleaning chemicals into the internal of the support panel, or the support panel can be manufactured from water and corrosion resistant materials.

Figure 2B:
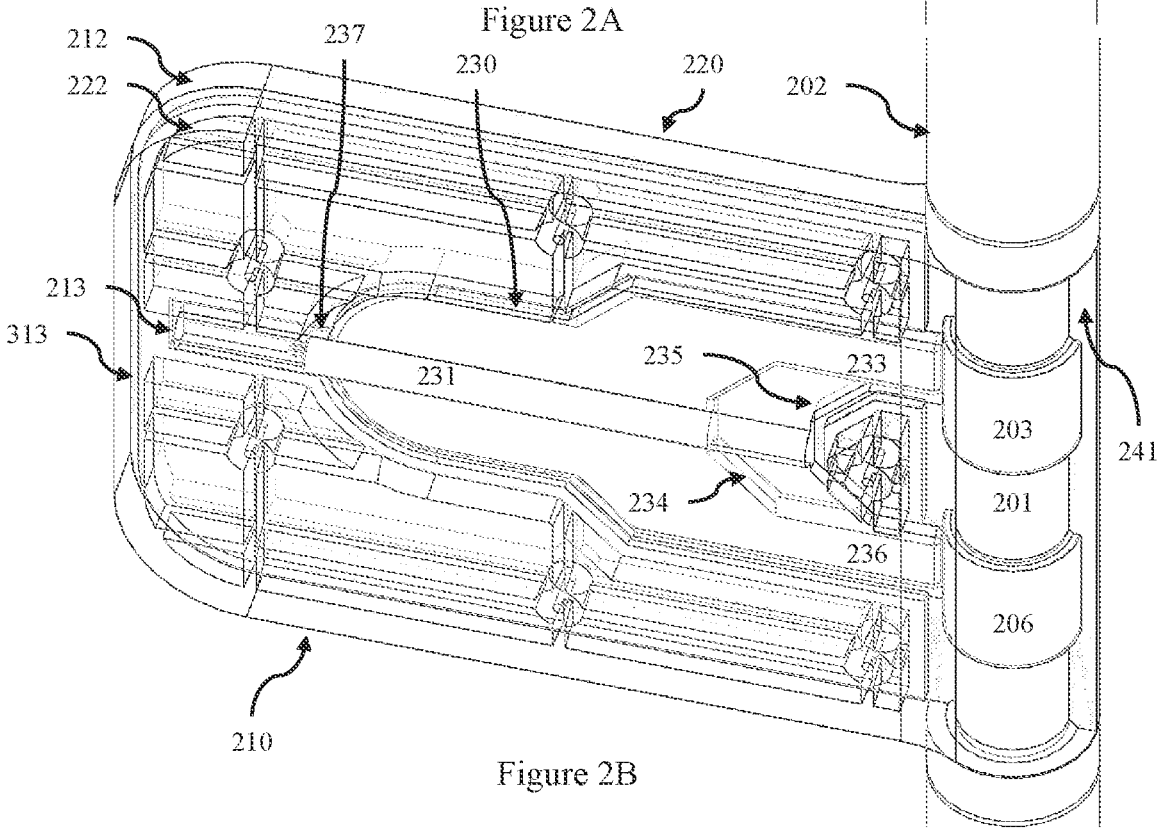
FIG. 2B is a reverse side isometric view of the support panel of FIG. 2A with the housing made transparent.

The locking arrangement (230) is housed between the two plates (212 and 222) and comprises an approximately U-shaped locking plate (231) with upper prong (233) and lower prong (236) which form a U-shaped cut-out (234) near the proximal end (with respect to the frame element 202). A matching stop (233) is formed in the rear plate (212). A handle projects through an aperture (224) in the rear side (220). FIG. 2B is a reverse side isometric view of the support panel of FIG. 2A with the housing made transparent to show plate (230).

Figure 2C:
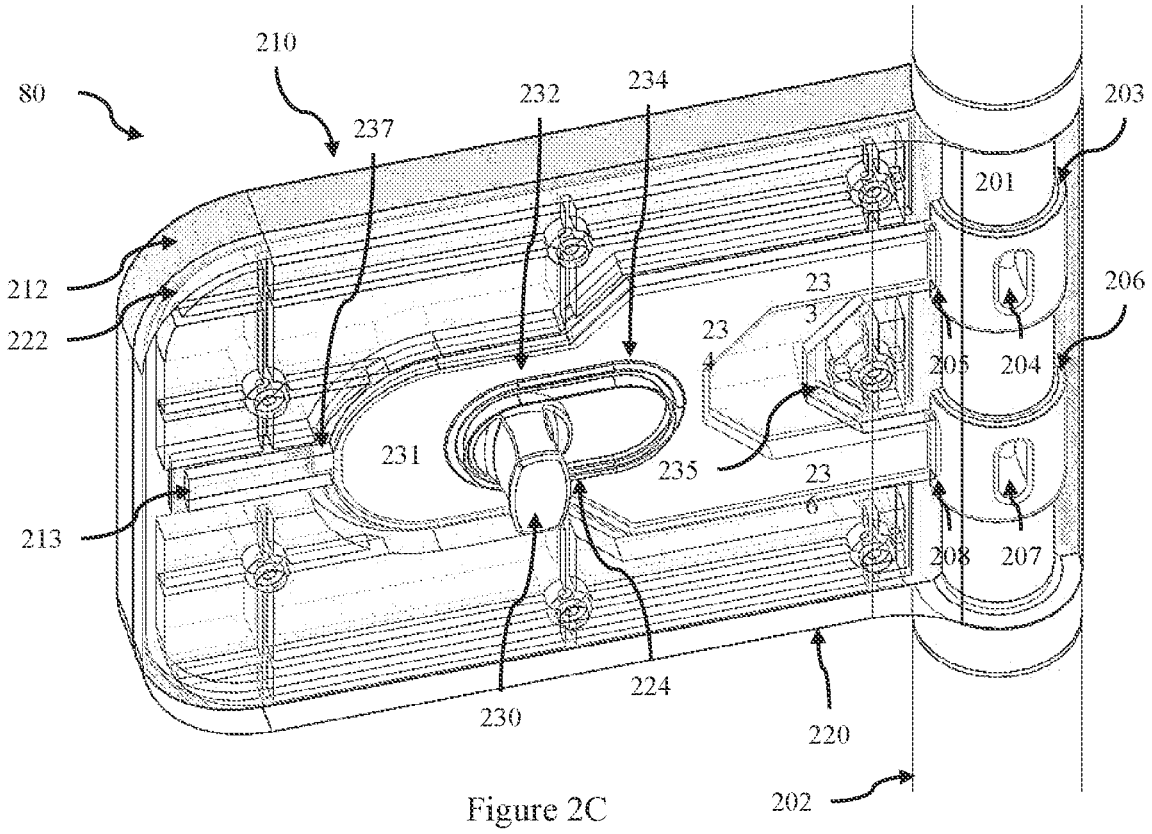
FIG. 2C is the isometric view of FIG. 2A with the housing made transparent showing the locking arrangement in an unlocked position.
Figure 2D:
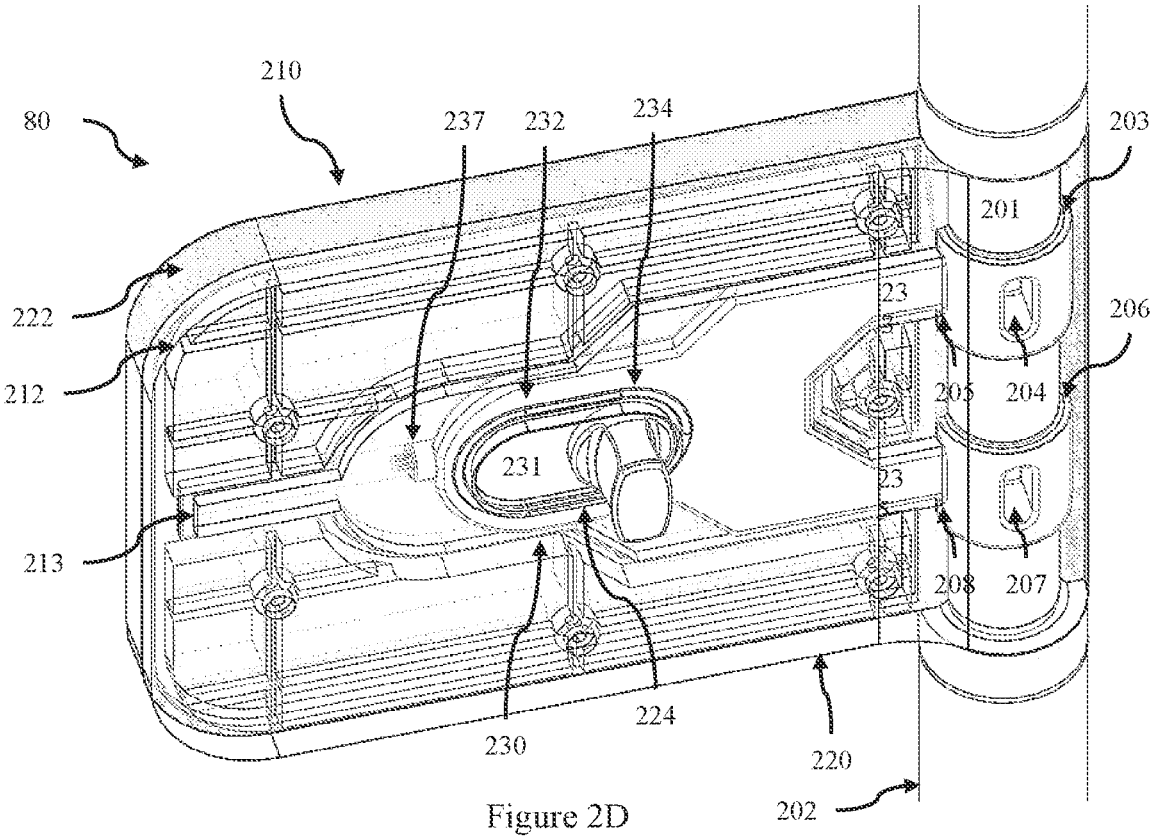
FIG. 2D is the isometric view of FIG. 2A with the housing made transparent showing the locking arrangement in a locked position.
Figure 2E:
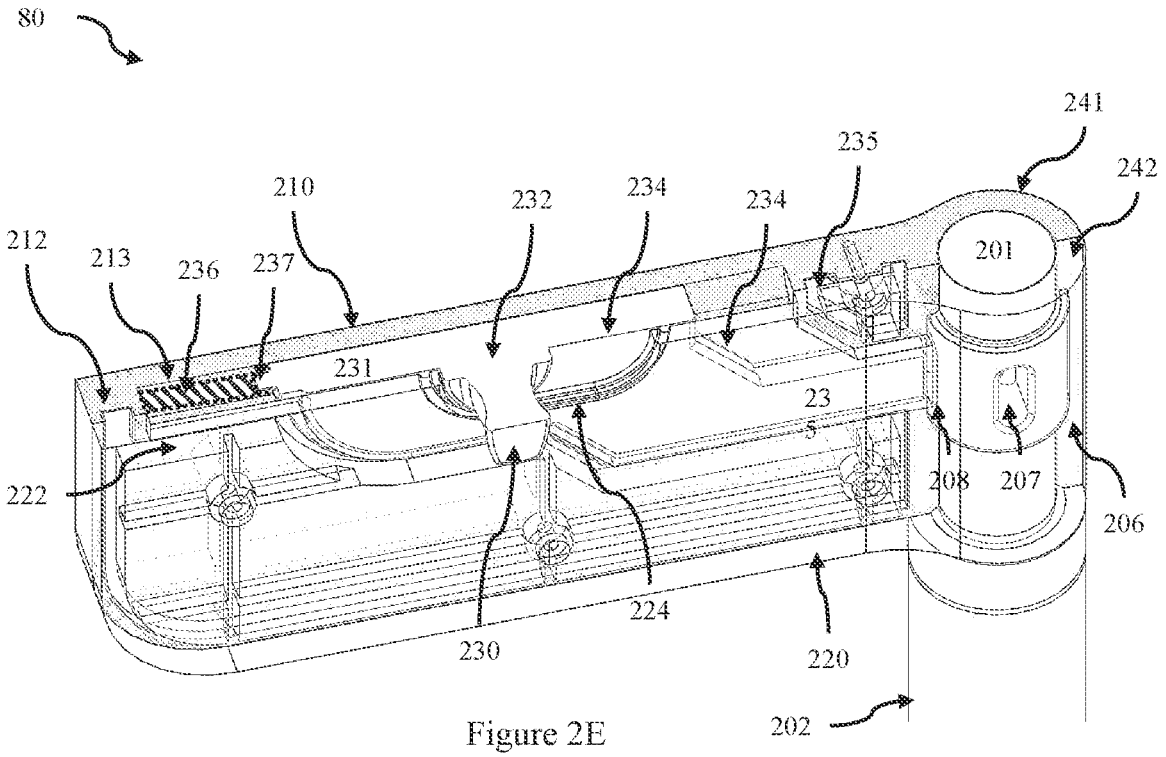
FIG. 2E is an isometric sectional view taken through the mid line of FIG. 2C.
Figure 2F:
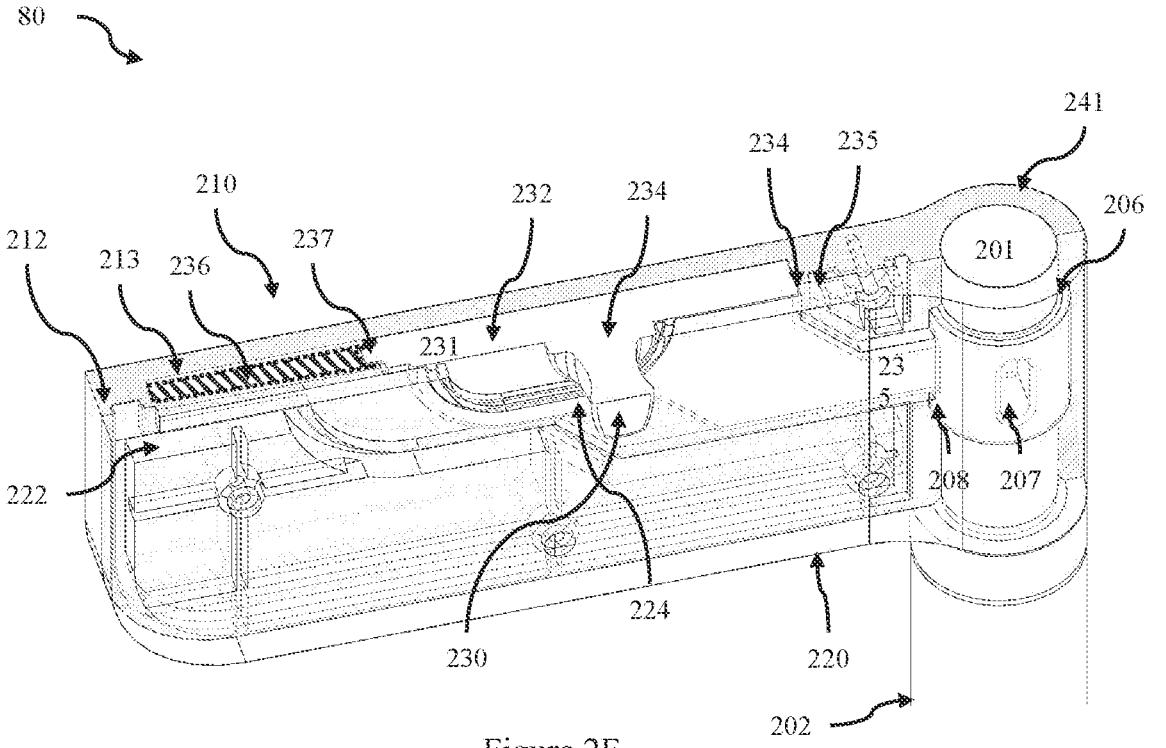
FIG. 2F is an isometric sectional view taken through the mid line of FIG. 2D.

FIG. 2C is the isometric view of FIG. 2A with the housing made transparent showing the locking arrangement (230) in an unlocked position and FIG. 2D is the isometric view of FIG. 2A with the housing made transparent showing the locking arrangement (230) in a locked position. FIG. 2E is an isometric sectional view taken through the mid line of FIG. 2C and FIG. 2F is an isometric sectional view taken through the mid line of FIG. 2D. Similarly FIG. 2G is an isometric sectional view taken through an upper section of FIG. 2C and FIG. 2H is an isometric sectional view taken through an upper section of FIG. 2D.

Figure 2G:
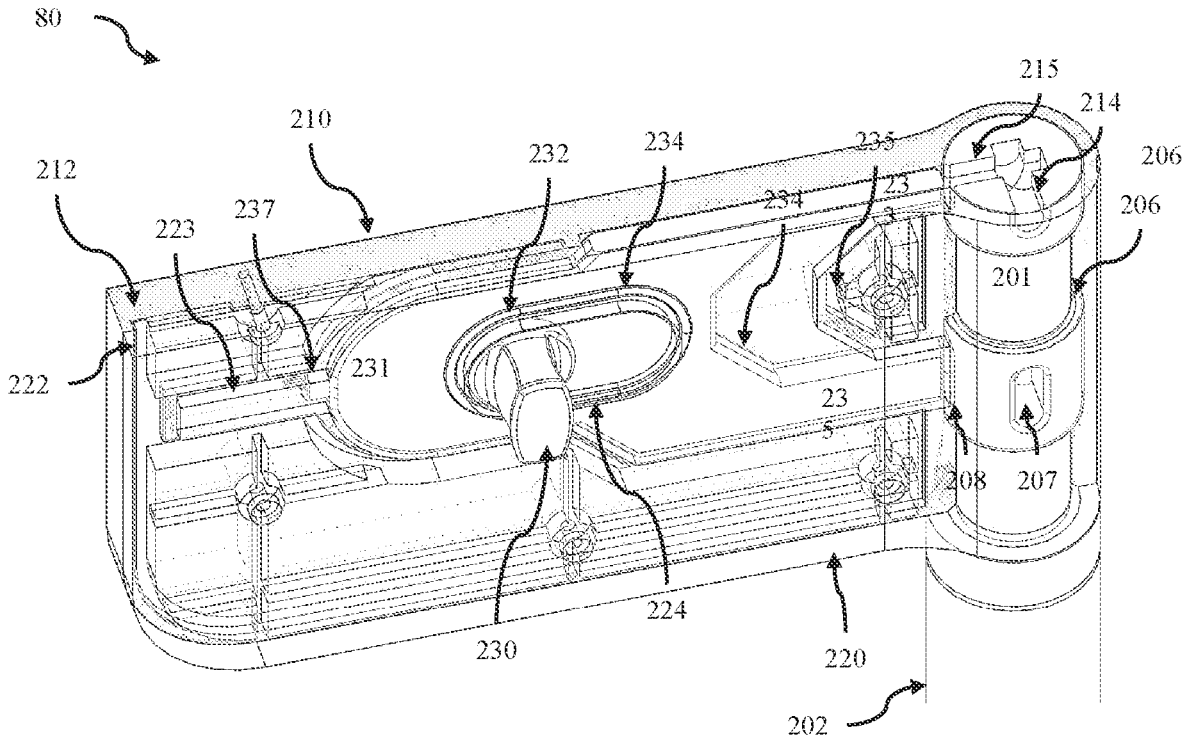
FIG. 2G is an isometric sectional view taken through an upper section of FIG. 2C.
Figure 2H:
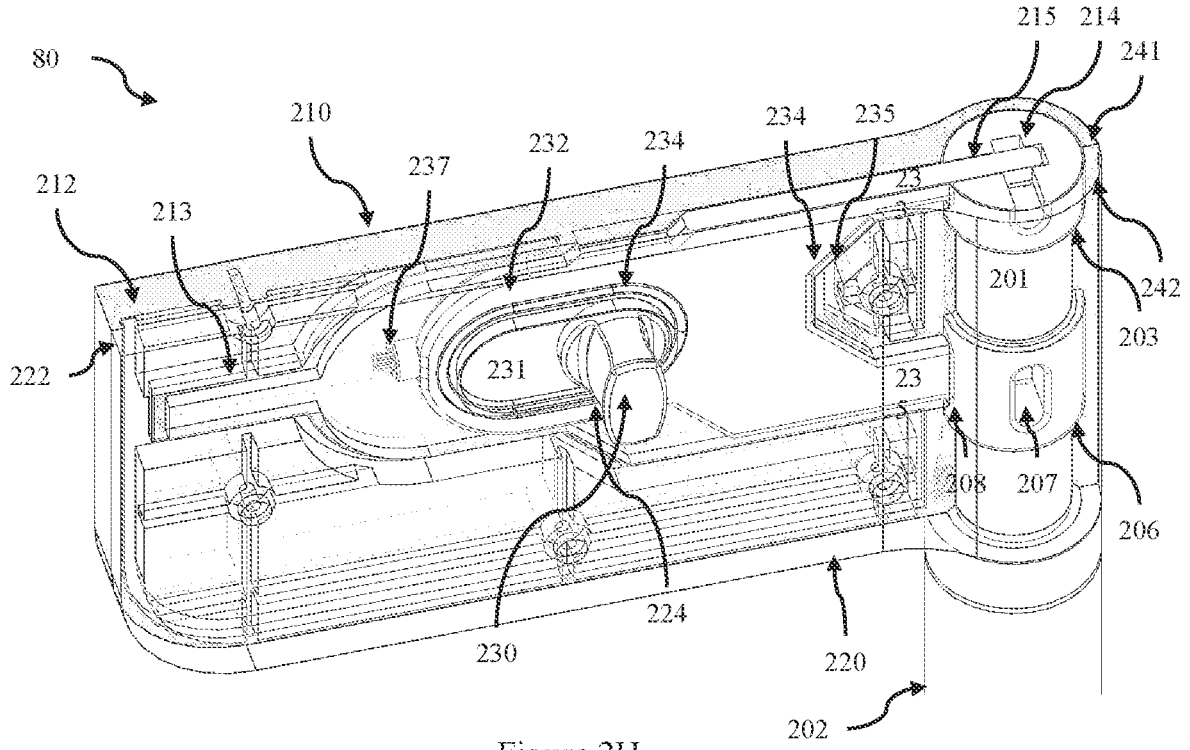
FIG. 2H is an isometric sectional view taken through an upper section of FIG. 2D.

As shown in FIGS. 2C to 2H, the frame element (202) comprises a central solid shaft (201) and upper locking sleeve (203) and lower locking sleeve (206). Each of the upper locking sleeves comprises two orthogonal locking apertures apertures (204 and 205) in upper sleeve (203) and apertures (207 and 208) in lower sleeve (206). Matching orthogonal slots (or apertures) (214 and 215) are provided in the solid shaft (201) in locations aligned with the apertures (204, 205) and (207, 208). The orthogonal slots are shaped to receive the prongs (ie proximal ends) (233 and 236) of the U-shaped locking plate (231). In the unlocked position (232) the handle is on the distal (left) side of aperture (224), and retracts the prongs from the apertures, and in the locked position the handle is moved to the proximal side of aperture 224 to engage the prongs (233 and 236) into respective matching apertures and slots (208, 205, and 215) or (204, 207, and 214). In the locking position the stop (235) stops U-shaped cut out (234). This is shown in FIGS. 2G and 2H which shows a cutaway of prong (233) initially retracted from slot (215) (in FIG. 2G, and then prong (233) inserted into slot (215) though aperture (205) in FIG. 2H. The first set of apertures (208 and 205) are used to lock the support panel in a support position (82), and the second set of apertures (204 and 207) are used to lock the support panel in an access position (84), orthogonal to the support position. In other embodiments locking positons could be provided in further orthogonal positions (around shaft 201) by providing slots (214 and 215) which pass completely through the shaft (201), and then providing further apertures in sleeves (203 and 206) opposite apertures (204, 205 and 207), and (208).

Additionally to provide a positive locking features, the locking plate (231) can be biased into a locking position by a biasing element such as a spring located in distal cavity (213) which engages with a projection (237) in distal end of locking plate (231) to provide a biasing force to drive the locking plate towards shaft (201) (and thus into slots (214 and 215) when appropriately aligned).

Figure 1J:
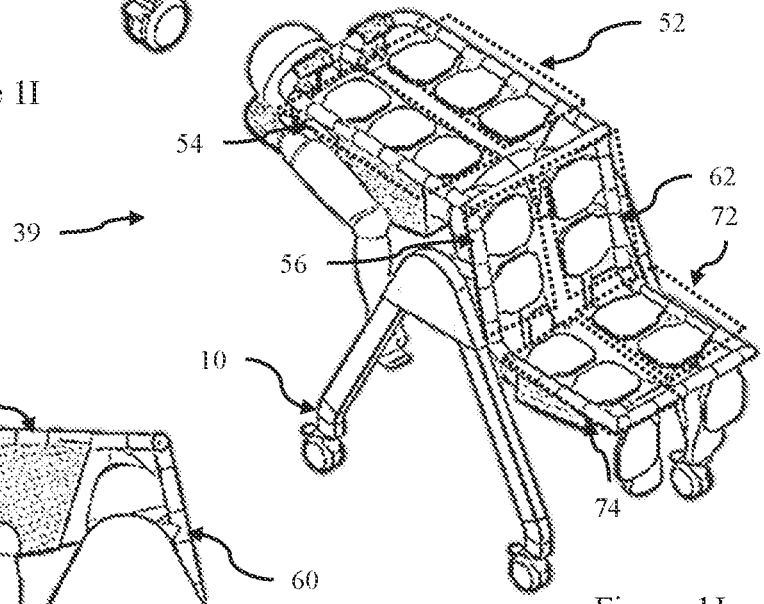
FIG. 1J is another isometric view of the patient sitting in a laid forward rotated position in the mobile patient support chair shown in FIG. 1A supported by the harness shown in FIG. 1G.
Figure 1K:
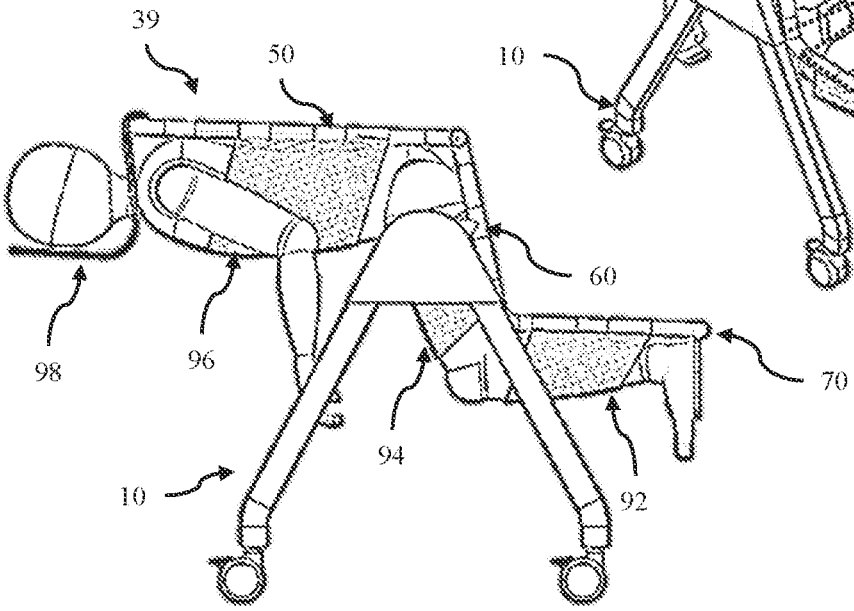
FIG. 1K is an side view of the patient sitting in a laid forward rotated position in the mobile patient support chair shown in FIG. 1A supported by the harness shown in FIG. 1G.

In this embodiment the support panels are arranged in groups. As shown in FIG. 1J the support panels are arranged into a first back group (52), a second back group (54), a first seat group (62), a second seat group (64), a first leg group (72), and a second leg group (74). In one embodiment the support panels in a group are linked so that they are movable between support positions and access positions as a group. In one embodiment the pivot mountings for each of the support panels in a group are linked, either via an internal member within the frame or an external linking member. Additionally or alternatively linking members may extend between each support panel in a group to link the support panels in the group. For example the lower pivot sleeve (244) of a first support panel could be linked to the upper lower pivot sleeve (243) of the next lower panel by at least one linking members running within frame element (202). Thus as one panel is rotated (pivoted) the linking member would drive rotation of the other linked panels in the group. In one embodiment, a single locking handle may be provide in one of the paddles in the group, and a link element between adjacent support panels connects the prongs of the locking plates in adjacent support panels. In this way a single handle can be used to lock and unlock the group of support panels.

Figure 1L:
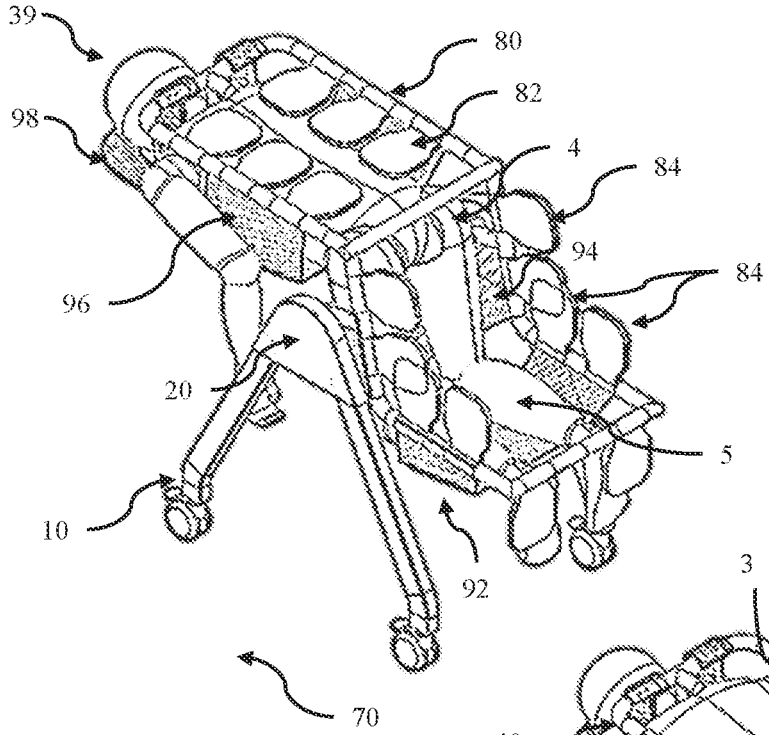
FIG. 1L is an isometric view of the patient sitting in a laid forward rotated position in the mobile patient support chair shown in FIG. 1J in which the support panels in the seat and leg portions are rotated to the access positions.
Figure 1N:
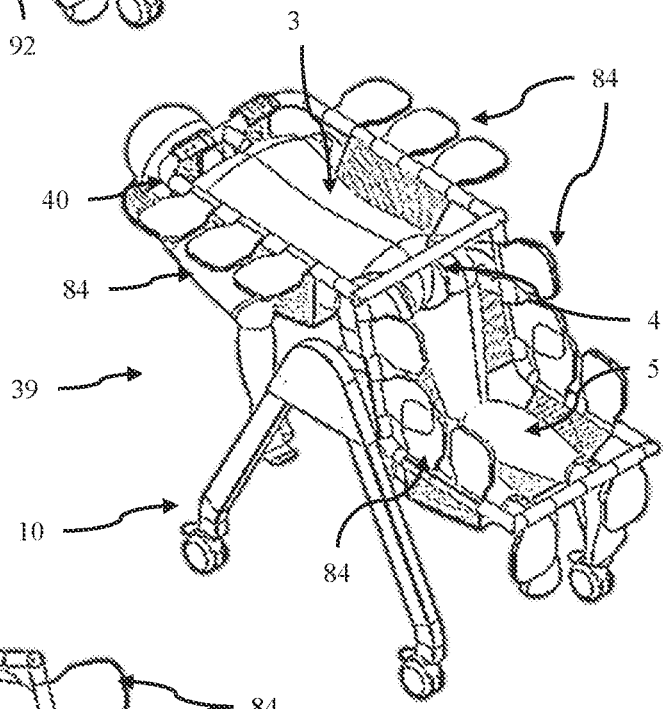
FIG. 1N is an isometric view of the patient sitting in a laid forward rotated position in the mobile patient support chair shown in FIG. 1J in which the support panels in the back, seat and leg portions are rotated to the access positions.
Figure 1M:
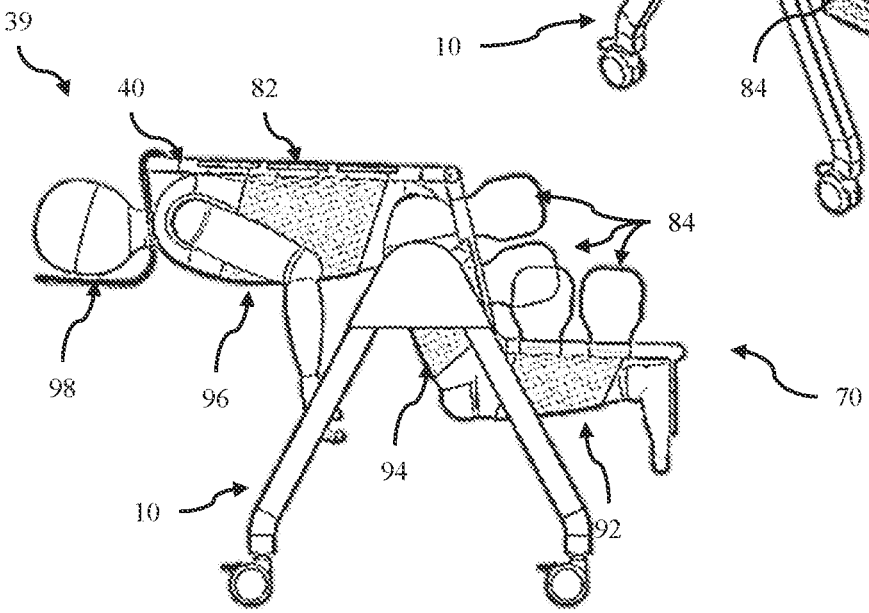
FIG. 1M is a side view of the patient sitting in a laid forward rotated position in the mobile patient support chair shown in FIG. 1L.

One issue with existing devices is that is difficult for carers to easily access areas such as the back (3), buttocks (4) and back of legs (5) without the carer needing to get on their hands and knees to clean them. Thus the support chair is designed to allow rotation of the chair (30) with respect to the support frame (10) into a forward bent leg lying position (39) as shown in FIGS. 1G through 1M. In order to support the patient when in the forward lying position (39), a harness arrangement is used to support the patient. The harness arrangement is provided as a plurality of flexible retaining portions (or strips) (90) that are either removable or retractably attachable to the chair frame (40). When attached each flexible retaining portion extends from a first side of the chair frame to a second opposing side, eg left-to-right sides or right-to-left sides of the chair frame (40). This retains the patient (2) against the inner side (32) of the chair as the chair is rotated and locked in a forward position (39) or even in a rearward position (38). As shown in FIGS. 1L to 1N, the support panels (80) can be progressively moved or rotated to the access position to provide access to the back (3), buttocks (4) and back of legs (5) of the patient (2). This allows the carer to easily access and clean these areas, or apply treatments for bed sores or physiotherapy.

The harness may be formed of separate flexible retaining portions or the flexible retaining portions may be provided on rollers permanently mounted to one side of a frame to allow extension and retraction of the retaining portions. The flexible retaining portions may be provided as strips or bands, or provided as shaped body panels, and may be reinforced to provide additional structural strength and support. Further as they will be adjacent to the patient's skin they may be padded and constructed of soft and easy to clean materials. The harness may also include a reinforced face support component which extends from the top of the chair frame 40 to frame and support the patients face. This may include reinforcing or supports or be constructed as a semi-rigid frame, with padding on the inner (face contacting) surface. The attachment mechanism for the flexible retaining portions may use clips, carabineers, shackles, pins, keys, or other lockable attachment arrangements. In one embodiment the harness is provided in two locking parts, in which the edges are permanently attached to each side of the chair and the two parts meet in the centre and can be locked together for example using clips on adjustable straps. To ensure safe operation an interlock arrangement or a harness attachment detection arrangement so that forward rotation of the chair from the sitting position (36) is only allowed if the harness is attached.

As discussed above, many elderly carers have little or no upper body strength. Thus in one embodiment the chair further comprises a rotation assistance arrangement to control rotation of the chair (30) about the support frame (10) so that a carer is only required to guide the rotation of the chair to and from the sitting position (36) to one of the rotated positions. This allows an elderly carer to easily rotate the patient (2) from the sitting position (36) either to a fully forward lying position (39) or fully rearward lying position (38) without using any significant upper body strength to drive the rotational movement. In conjunction with rotation of the support panels (80) to the access position, this allows a carer to wash areas that in a normal seated position would be pointed to the floor (ie support the patient's weight) such as back (3), buttocks (4) and back of legs (5). In the forward bent leg lying position (39), the back and bottom support panels (80) can then be simply rotated to the access position by the carer allowing full access to the full back of their body. This allows full access for cleaning and also allows for any treatments of pressure sores, massage and physiotherapy.

The rotation assistance arrangement may be a passive system which allows manual adjustment of the location of the centre of gravity 650 with respect to the pivot point or shaft 630 for the chair so that it can be configured for a specific patient. The pivotable mounting arrangement (20) comprises a set of pivot locations to allow the pivot point (or picot shaft 630) for a patient to be configured to match their centre of gravity (COG) 650. To determine suitable pivot locations a survey of 69 people was conducted to determine the range of centre of gravity (COG), and thus the set of pivot locations required. Each pivot location is assigned a corresponding reference body type with associated COG. The factory default is set as the average COG, and during configuration of the system for a patient, their body type can be compared to the reference body type (and COG) corresponding to each pivot location, and the pivot location set to the closest match. For example the mounts of the pivot mounting plate 640 may be adjustable mounts to allow vertical and lateral adjustment of the location of the mounting plate 640 and pivot shaft 630. In another embodiment an active system which positively adjusts the centre of gravity to ensure it remains centred around the pivot point to ensure easy rotation. This could be based on using the set of defined pivot locations and sensing torque or other loads or forces that arise during rotation of the patient, and the system could adjust the pivot location to reduce these.

In one embodiment the mobile support chair is further adapted to assist a carer move the patient from a lying position on the bed into a seated position in the chair. Current transfer systems require the use of hoists or a conveyor system that that moves the lying patient down the bed towards a waiting chair. These typically require supervision and assistance of an able bodied carer with sufficient upper body strength to assist and potentially catch (or carry the weight) of the patient during the bed to chair transfer. Thus in one embodiment the support panels in the back portion and the upper cross member of the back portion (50) and head support (44) are adapted to rotate through 180°. This allows a patient to be transferred from a bed onto the seat through the space (302) occupied by the back frame when in the back support position.

Figure 3A:
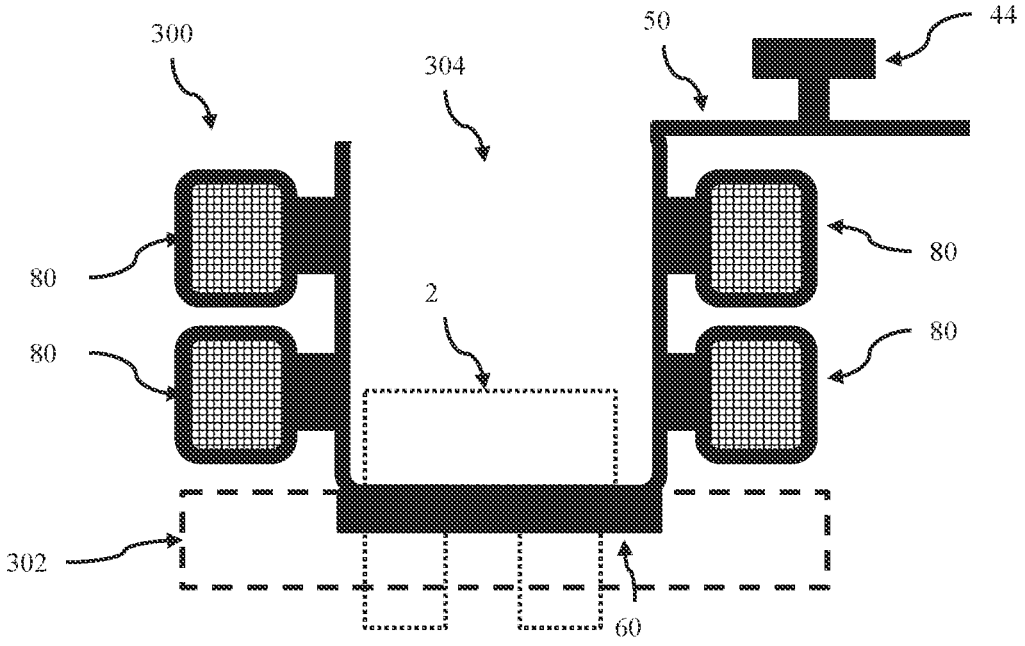
FIG. 3A is a view of the back portion in a patient transfer configuration according to an embodiment.
Figure 3B:
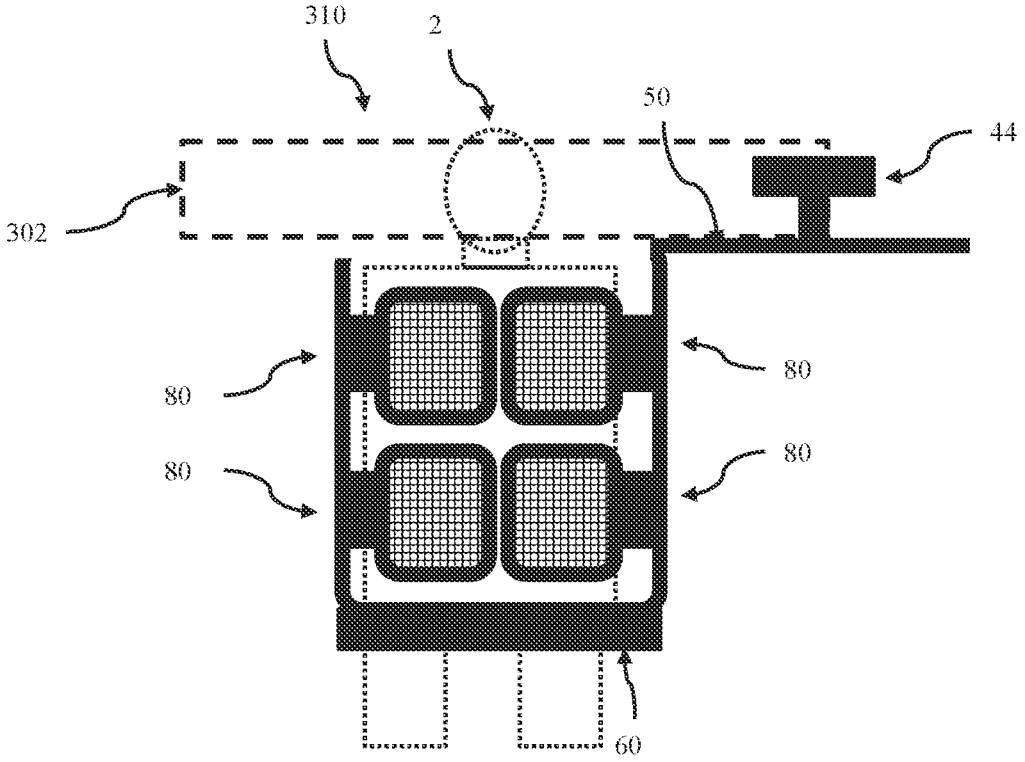
FIG. 3B is another view of the back portion in a patient transfer configuration according to the embodiment shown in FIG. 3A.

This embodiment is illustrated in FIGS. 3A and 3B. In this embodiment the carer rotates the back portion support panels (80) and upper cross member through 180° to a patient access position (300), or alternatively the back portion and upper cross member are removed, and the chair is placed at the end of the bed as shown in FIG. 3A. The height of the bed (302) is adjusted to the height of the seat frame, and then—the bed height is adjusted and the chair position move via a docking station to best accommodate the patient's body shape and weight to control any gap that may exist between the chair and the bed. In a conveyor belt bed system the bed (302) can then be raised or adjusted in conjunction with the docking station to—place the back of the patient into a sitting position and support the patients back. The back frame support panels can then be placed back on to the chair frame to support the patients back to the normal back support position (200), and locked in place. The bed (302) can then be raised higher to support just the head as shown in FIG. 3B, and the upper cross member of the back portion (50) and head support (44) can be—placed back to normal back support position (310) and locked in place.

FIGS. 8A to 8M illustrate an embodiment of a docking or transfer station (800) that receives the chair for docking with a conveyor bed, or similar motor driven beds or furniture to allow transfer of the patient in and out of the chair. The docking station is designed to capture the chair (eg via chair docking pin 703 located in the rear wheel housing 701) when the chair is place in front of the bed in a rearward position. The station then controls the positioning of the chair in both a forward and rearward action and in the rotating position of the chair via the chair drive coupling 706 located in the rear wheel housing 701 (which as discussed above can be used to drive the worm gear 712). These actions are completely independent of the bed which can be independently moved. The capture and control of the two functions of the chair is controlled by a programmable logic controller (PLC) or similar microprocessor. This programing then aligns the chair and the bed through the station to the best position for patient transfer for both on and off the bed—the two functions differ in their specific requirements.

The station also allows for soiled bedding and clothing to be captured as it comes off the bed (via the conveyor) in a removable bucket for cleaning. This directs all soiling to the bucket keeping the station clean.

Figure 8A:
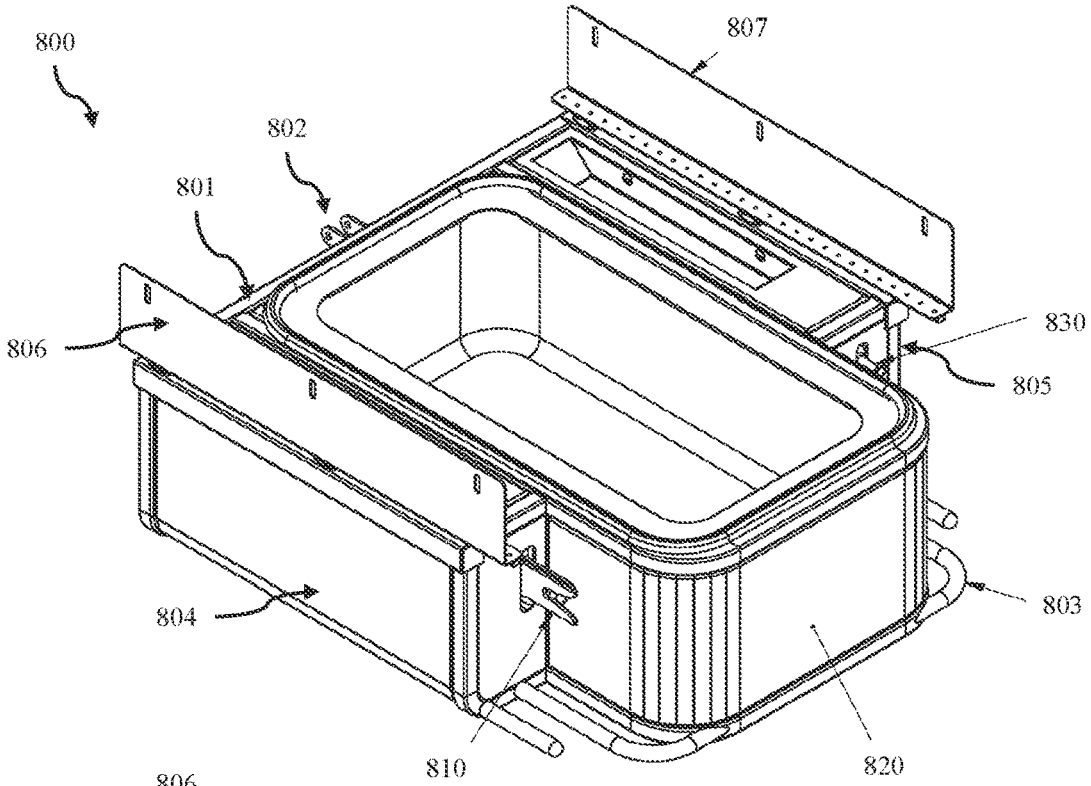
FIGS. 8A, 8B, 8C and 8D show isometric, top, side, and rear views of the transfer station according to an embodiment.
Figure 8B:
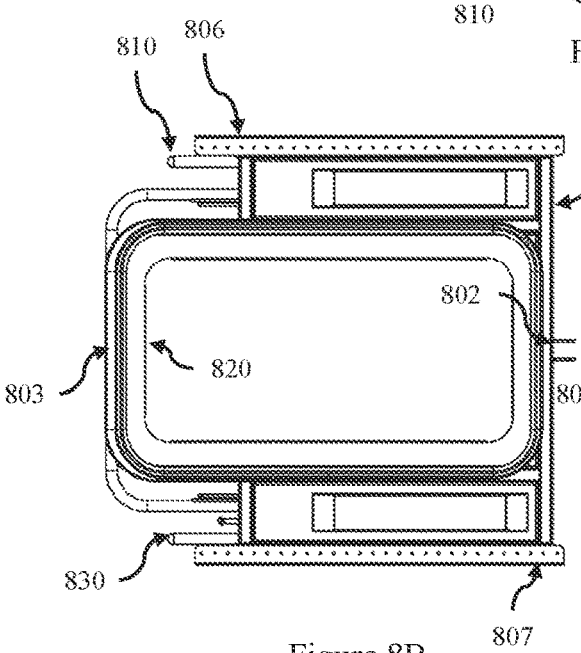
Figure 8E:
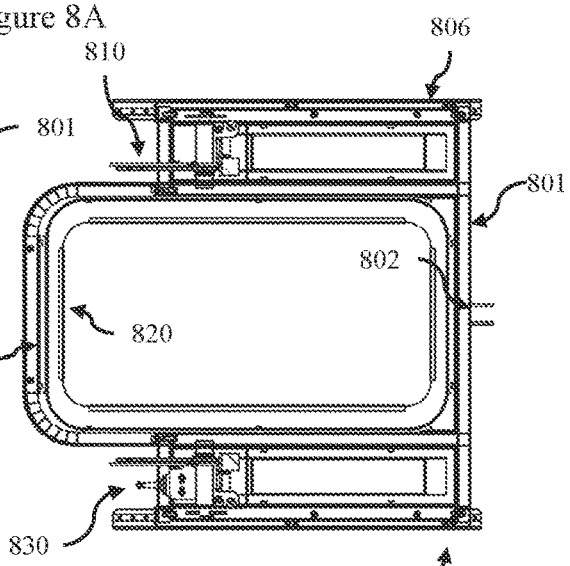
FIG. 8E shows a section view through FIG. 8C
Figure 8C:
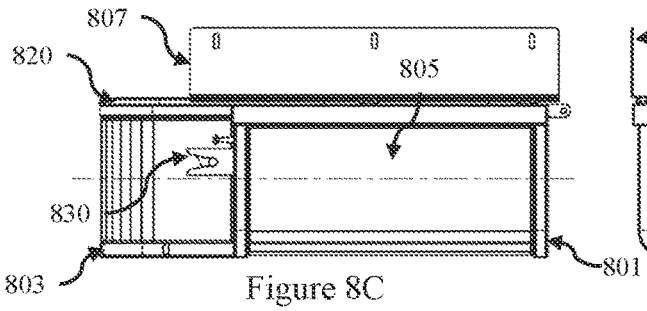
Figure 8D:
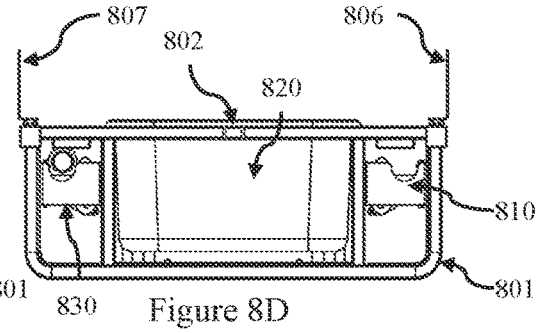
Figure 8F:
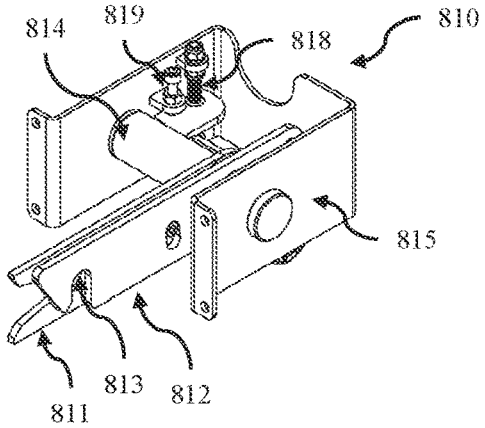
FIG. 8F show an isometric view of the first docking assembly according to an embodiment.
Figure 8G:
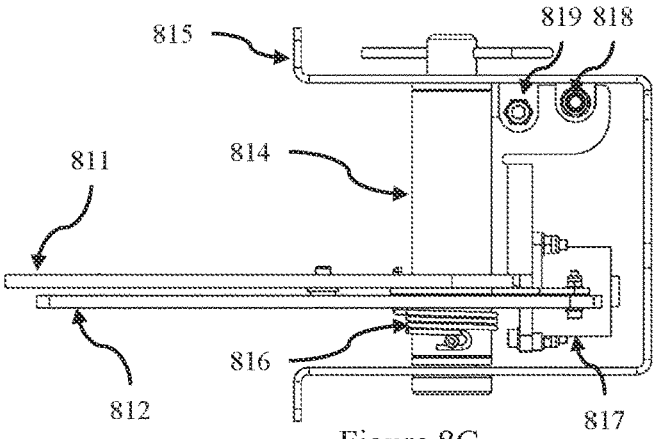
FIG. 8G shows a top view of the first docking assembly according to an embodiment.
Figure 8H:
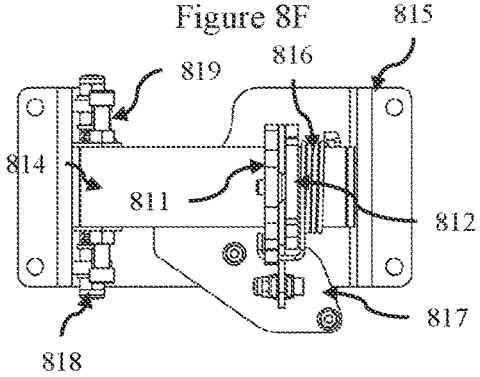
FIG. 8H shows a side view of the first docking assembly according to an embodiment.
Figure 8I:
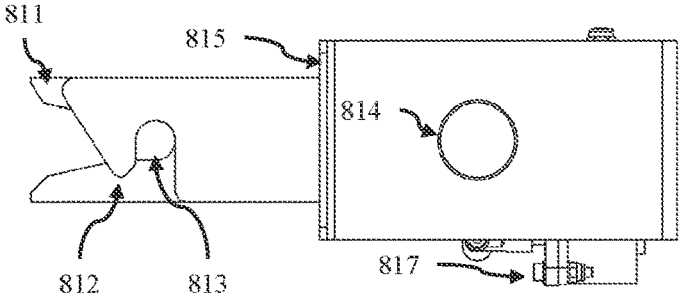
FIG. 8I shows a rear view of the first docking assembly according to an embodiment.

FIGS. 8A, 8B, 8C and 8D show isometric, top, side, and rear views of the transfer station. FIG. 8E is a section view through section AA of FIG. 8C. The transfer station (800) comprises a frame (801) supporting a removable bucket (820) which can be lifted out when the chair is undocked. The rear of the frame (801) comprises two flanges (802) which can be secured to a bed or similar structure if required. The docking mechanism comprises a first docking assembly (810) located in first side housing (804), which in this embodiment on the left hand side as viewed from the front (803). A second docking assembly (830) is located in second side housing (805) (in this embodiment located on the right hand side). Two side runners (806, 807) extend vertically from rails located on the first and second side housings (804, 805).

Figure 8J:
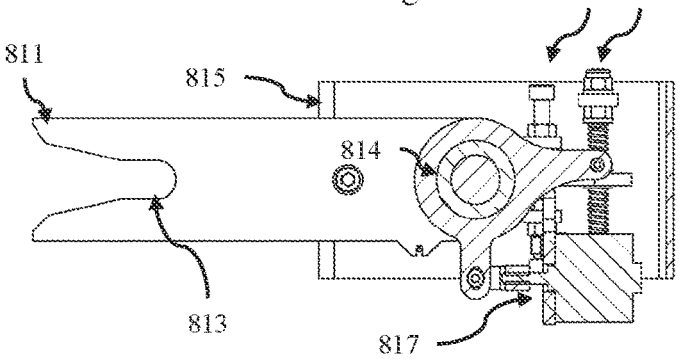
FIG. 8J shows a first section view through FIG. 8H.
Figure 8K:
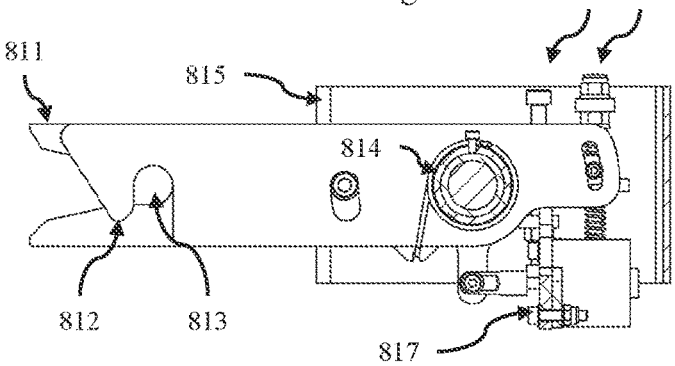
FIG. 8K shows a second section view through FIG. 8H.
Figure 8L:
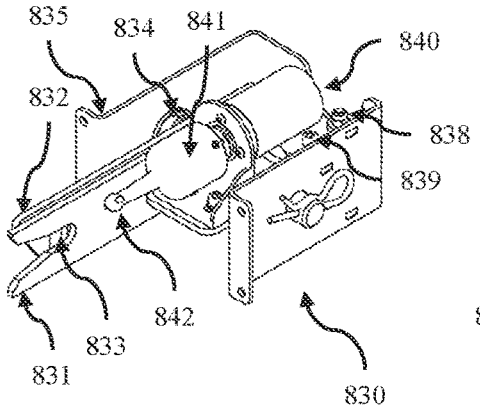
FIG. 8L show an isometric view of the second docking assembly according to an embodiment.
Figure 8M:
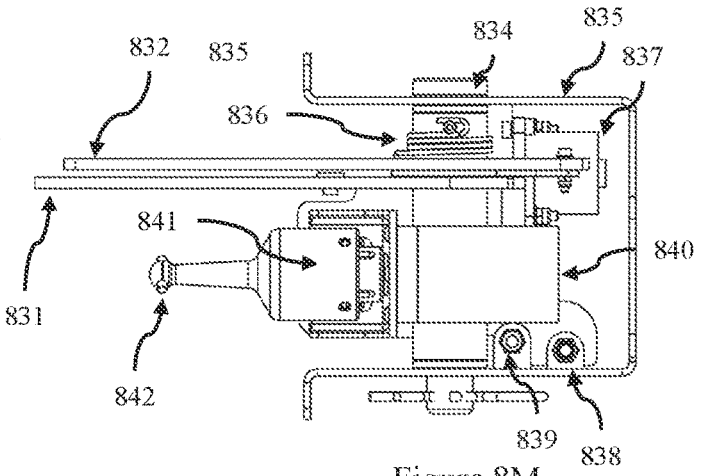
FIG. 8M shows a top view of the second docking assembly according to an embodiment.
Figure 8N:
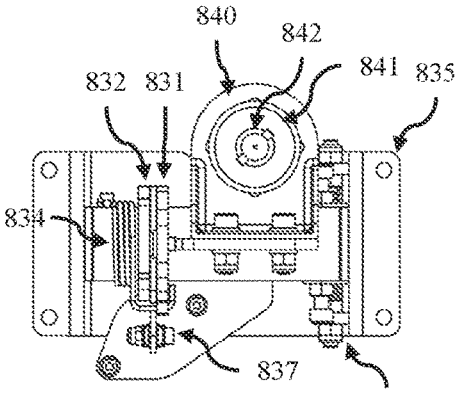
FIG. 8N shows a side view of the second docking assembly according to an embodiment.
Figure 8O:
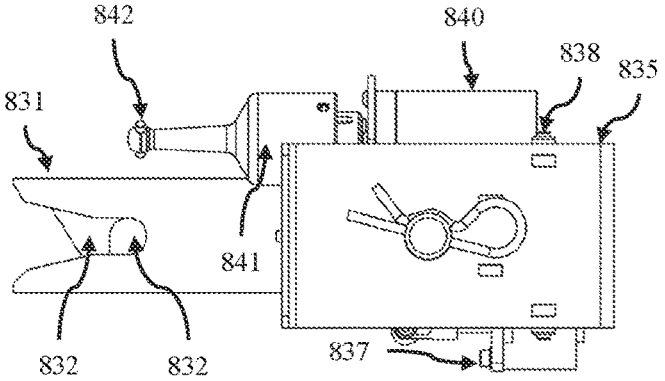
FIG. 8O shows a rear view of the second docking assembly according to an embodiment.

The docking assemblies are designed to receive chair docking pins (703) located in the rear wheel housings as chairs are wheeled (rearwardly towards the transfer station). FIGS. 8F, 8G, 8H and 8I show isometric, top, side, and rear views of the first docking assembly (810) and FIGS. 8J and 8K show sections through FIG. 8H. The docking assembly (810) comprises an alignment lever (811) and a retention lever (812) extending forward and mounted on a pivot pin (814) which is turn mounted in housing (815). The distal end of the alignment lever (811) is formed with two fingers and the distal end of the retention lever (812) is formed as a hook which define an aperture (813) that receives and secures a chair docking pin (703) extending laterally from the rear wheel housing (709). The alignment lever (711) and retention lever are separated by a spacer with a rearward projection and a downward projection (ie orthogonal to extension direction of levers (811, 812). The alignment lever (811) and retention lever (812) are configured to pivot with respect to each other about pivot pin (814) by a pivot arrangement. The pivot arrangement comprises a first slotted aperture in the mid-section of the retention lever (812) (forward of the pivot pin (814)) that receives a screw fastened to the alignment lever (811). A second slotted aperture in the retention lever (812) receives a fastener secured to the rearward projection of the spacer. A return spring (816) secured to the pin (814) extends around the pin (814) and hooks around the alignment lever, retention lever and spacer. The downward projection of the spacer is connected to a linear actuator (817) which extends and retracts in a forward and rearward direction, which thus causes the rearward projection to rotate about pivot (814), thus driving the retention lever to pivot with respect to the alignment lever, leading to opening of the aperture (813) to allow capture/release of the chair docking pin (703), or closing of the aperture (813) to retain chair docking pin (703). Additionally a horizontal flange extends from the pin (814) through which an adjustable self-centring spring arrangement (818) comprising a shaft with a spring passes. An adjustable end stop (819) is also provided comprising two screws positioned above and below the flange.

FIGS. 8L, 8M, 8N and 8O show isometric, top, side, and rear views of the second docking assembly (830). This is similar (mirror reflection) to the first docking assembly (810), with an alignment lever (831), retention lever (832), aperture (833), spacer, pivot arrangement, pivot (834), housing (835), retention spring (836), linear actuator (837), adjustable self-centring spring arrangement (838), and adjustable end stop (839). Additionally the second docking assembly comprises a planetary gearhead and motor 84 mounted above the pivot (835) and alongside the alignment lever (831) and retention lever (832) which drives rotation of a planetary gear arm (841) which ends in a ball with two radial projections (on the same axis) configured to engage and drive a receiving slot in the chair drive coupler (706) located in the wheel mount (701). This allows a controller to drive rotation of the chair once the legs of the chair are secured and held by the first and second docking assemblies (810, 830) of the transfer station (800).

A controller (not shown) controls operation of the linear actuators and the planetary gear motor in the docking assemblies to control capture and release of the chair, and rotation of the chair. The controller may be a PLC, microcontroller, general purpose microprocessor, a digital signal processor (DSP), an application specific integrated circuit (ASIC), a field programmable gate array signal (FPGA) or other programmable logic device (PLD), hardware state machine, discrete gate or transistor logic, discrete hardware components or any combination thereof. Each device may comprise a processor and memory comprising software instructions to control the linear actuators and the planetary gear motor in the docking assemblies. A user interface may be provided to allow execution of predefined docking/undocking programs, or manual control of the motors. The controller may interface with a bed controller to provide integrated transfer operations of patients.

Figure 3C:
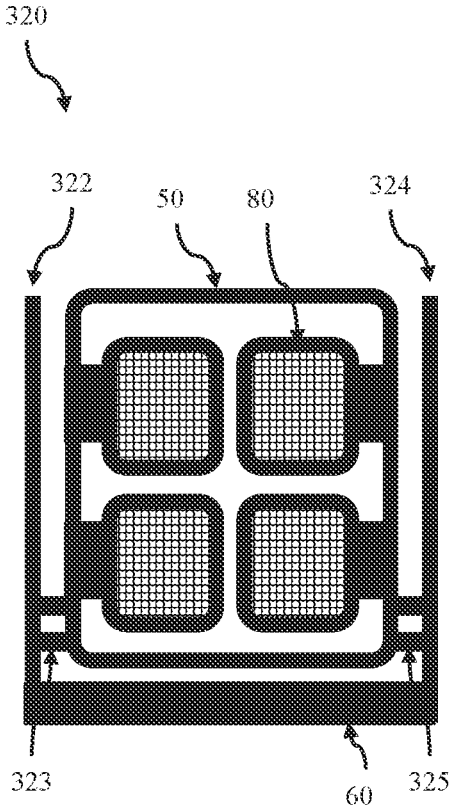
FIG. 3C is a view of the back portion in a patient transfer configuration according to another embodiment.
Figure 3D:
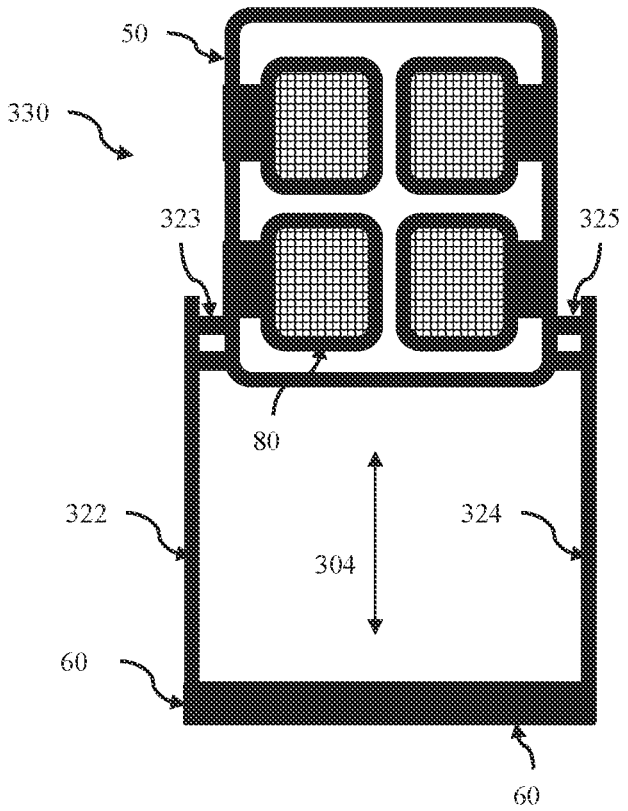
FIG. 3D is another view of the back portion in a patient transfer configuration according to the embodiment shown in FIG. 3C.

In another embodiment as illustrated in FIGS. 3C and 3D the chair (30) further comprises a pair of vertical supports (322, 324) extending upwards from the seat frame (60). The back frame (50) is then slideably mounted (323, 325) to the pair of vertical supports (322, 324). In this embodiment the carer can shift the position of the back frame (50) from the normal back support position (320) to be held in a patient receiving position (330) by sliding up or removing the back frame. The bed height is then adjusted to the height best suited to the patient, and then the patient can be placed on the chair/lifted of the chair, with little carer assistance (304). As the patient comes off the bed and is placed on the chair the chair seat rotates capturing and supporting the buttocks the seat position continues to rotate bring the buttocks to be engage fully with the seat panels with no drag of the patient's body as the seat position is rotating the bed height is being adjusted to aid in the feeding of the patient's buttocks onto the seat panel and once the buttocks on the support position (so the patient is half on the chair and half on the bed). The bed can then be raised or adjusted to push the back of the patient into a sitting position and support it. The back frame (50) can then be slid back down between the patient and the bed to the normal back support position (320), and locked in place.

In another embodiment each of the panels in the back portion, seat portion and leg portion are separately removable. These can be replaced with solid support section to convert the chair to a day chair. This can be done with the patient sitting in the chair by pivoting of the chair.

Unlike specially designed aged care facilities many bathrooms in existing homes have a small step up into the room created by screed, tiles and terrazzo flooring methods, and often a further small step or lip into or out of the shower cubicle, for example between about 1 cm and 2.5 cm. In some cases the shower cubicle may be recessed, and thus the lip may occur when pushing the patient out of the shower cubicle. As discussed above, many elderly carers have nor or limited upper body strength, and have difficulty in safely lifting or pushing a wheelchair and patient up or over such a step or lip. Thus in one embodiment the wheel arrangement (14) at the end of each leg is a step-climbing wheel apparatus for small floor profile differences such as steps or lips. The step-climbing wheel apparatus comprises a wheel mounting arrangement comprising at least three wheels arranged in a fixed triangular geometry such that when on a flat surface at least one wheel is in contact with the flat surface and at least one wheel is in an elevated position to define a vertical separation distance. A drive arrangement engages the wheel mounting to assist the mobile patient support chair to climb a step with a height less than the vertical separation distance. Additionally a chair leg mounting arrangement to mount the wheel mounting arrangement to a chair leg.

Figure 4A:
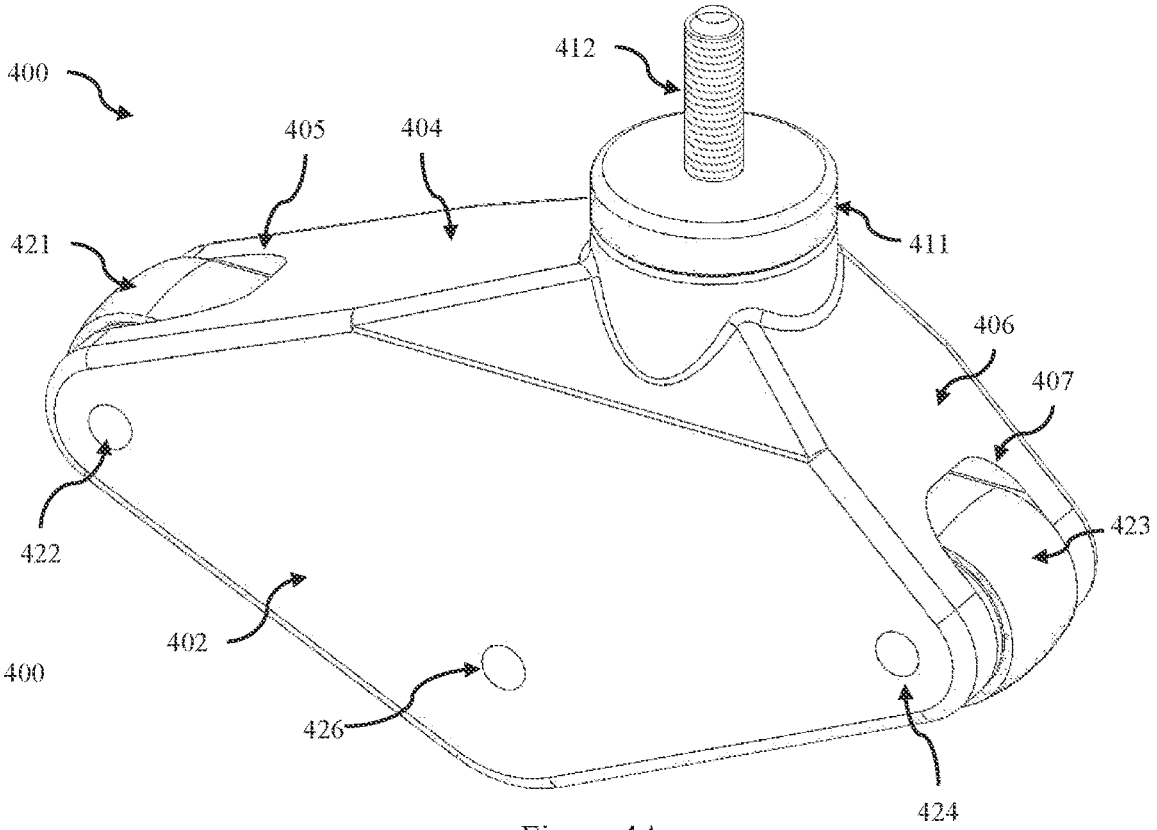
FIG. 4A is an isometric view of a step-climbing wheel apparatus according to an embodiment.
Figure 4B:
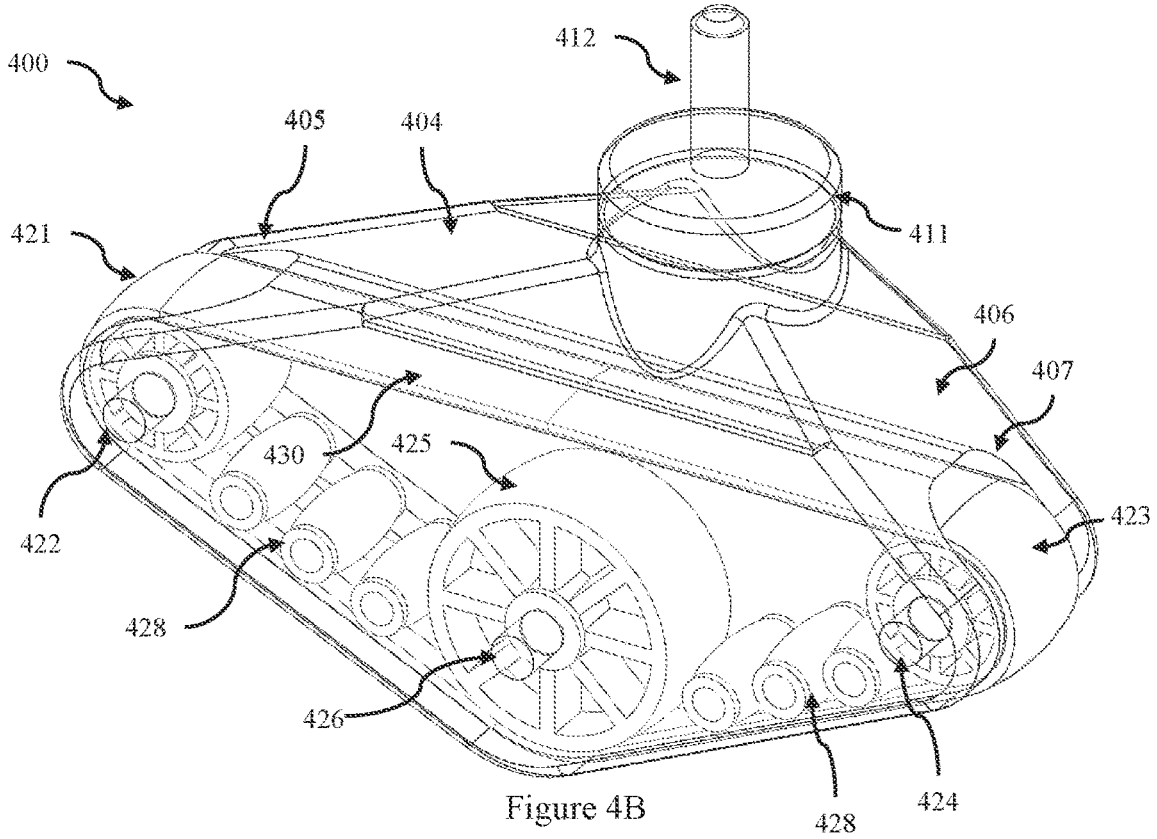
FIG. 4B is the isometric side view of FIG. 4A with a transparent housing.
Figure 4C:
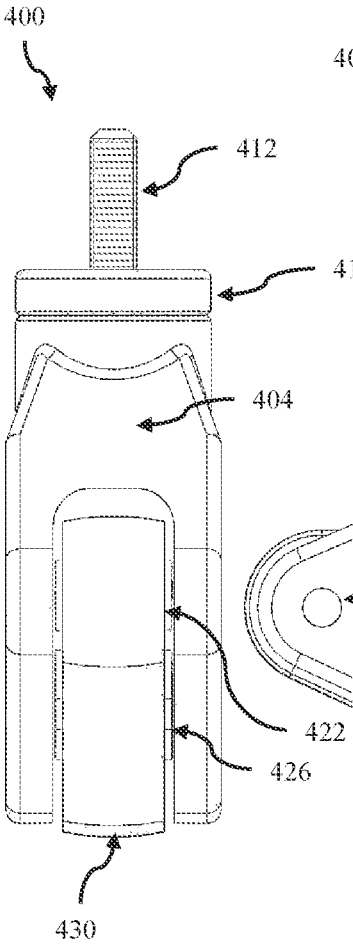
FIG. 4C is a front view of the embodiment shown in FIG. 4A.
Figure 4D:
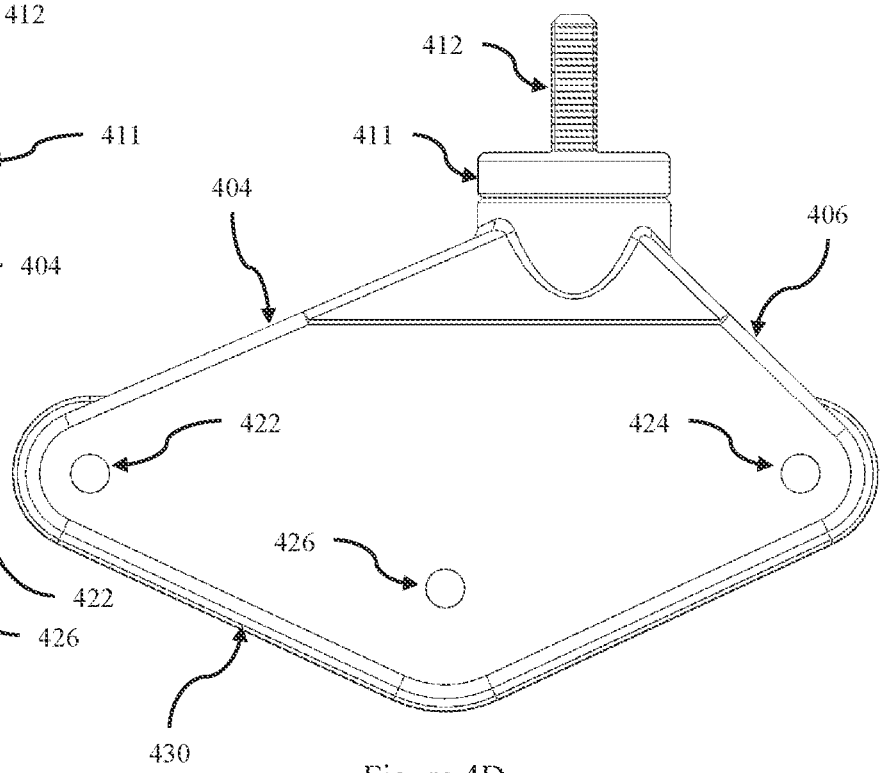
FIG. 4D is a side view of the embodiment shown in FIG. 4A.
Figure 4E:
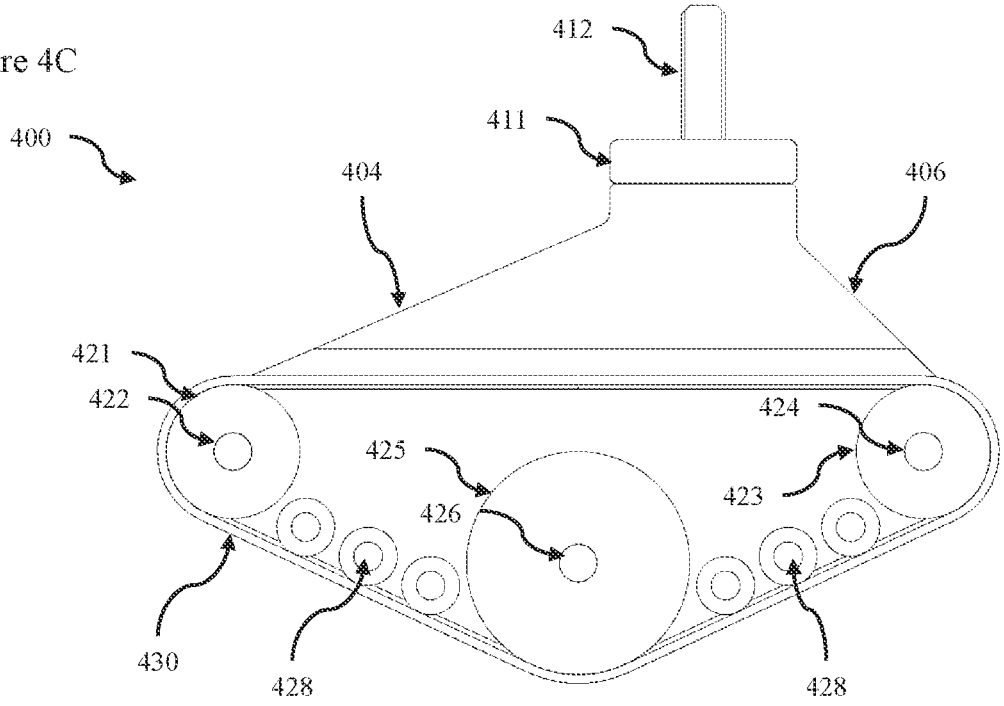
FIG. 4E is the sectional view taken along the midline of FIG. 4C.

FIGS. 4A to 4D show an embodiment of a step-climbing wheel apparatus (400) for climbing a step. FIG. 4A is an isometric view, FIG. 4B is the isometric side view of FIG. 4A with a transparent housing, FIG. 4C is a front view, FIG. 4D is a side view, and FIG. 4E is the sectional view taken along the midline of FIG. 4C. In this embodiment the wheel arrangement comprising a housing (401) with side panels (402, 403), and upper forward panel (404) and upper rear panel (406). The housing (401) houses and supports a front wheel (421) on front axle (422), a rear wheel (423) on rear axle (424) and a central drive wheel (425) mounted on central axle (426). In this embodiment the drive arrangement is track (430) looped around the three wheels and which is guided by rollers (428). The upper forward and rear panels (404) 406 are provided with apertures (405) 407 to allow the track (430) to move between front and rear end wheels (421) and (423). The step-climbing wheel apparatus (400) is mounted to the end of chair leg using a chair leg mounting arrangement (412) comprising a threaded shaft (412) which is received in a corresponding shaft in the end of each chair leg.

As shown in FIGS. 4D and 4E, the drive wheel (425) is larger than the front and rear wheels (421, 423), and are mounted in an isosceles triangular geometry (with the wheels at each apex) such that the track between the front and rear wheels is parallel to the flat ground, and the drive wheel (425) is mounted lower than the front and rear wheels to create an inclined track between the front wheel (421) and driver wheel (425). Thus when moving on level ground, the track in the vicinity of the drive wheel (425) contacts the ground, and if a step is encountered then the inclined track between the front wheel (421) and drive wheel (425) will contact the step at a first point of contact. Continued forward movement of the chair will allow the track to rotate with respect to the wheels (the point of contact between the step and track is fixed) allowing the wheel arrangement to traverse the step. In one embodiment the wheels are free to rotate and the wheels are driven by the person pushing the chair. In other embodiment a motor could be provided to drive rotation of the drive wheel (525). In another embodiment an energy storage arrangement is included that stores energy generated by rolling movement of the mobile patient support chair. That is, as the carer pushes the patient around, this gradually energises the energy storage arrangement. A drive arrangement is configured to use the stored energy to drive rotation of the drive wheel (525) when a step, or resistance to forward movement is detected.

FIGS. 5A to 5D show an embodiment of a step-climbing wheel apparatus (500) for climbing a step. In this embodiment the apparatus (500) comprises three wheels (511, 512, and 513), a central axle (520), and a wheel mounting arrangement (530) mounted on the central axle (520). Each of the wheels (511, 512, and 513) is mounted about the central axle (520), and the central axle (520) is mounted in the leg (12) of the chair. As can been see in FIGS. 5A to 5C, the wheels arranged in a fixed triangular geometry such that when on a flat surface at least one wheel is in contact with the flat surface and at least one wheel is in an elevated position to define a vertical separation distance. An energy storage arrangement (540) is also included that stores energy generated by rolling movement of the mobile patient support chair. That is, as the carer pushes the patient around, this gradually energises the energy storage arrangement (540). A drive arrangement (550) is configured to use the stored energy to drive rotation of the wheel mounting arrangement (530) around the central axle (520) to assist the carer to push the chair up the step or over the lip. The drive arrangement (550) may be configured to automatically release the stored energy upon detection of a step or lip (eg on encountering sufficient resistance to forward motion), or the arrangement can be configured so that the carer can manually trigger step traversal (energy release). Thus rather than requiring the carer to perform a heavy lift or push to get the chair up a step or over a lip, the energy exerted by the carer is gradual, and thus this design allows a person of small stature to move a larger person with relative ease. In most cases the steps or lips 2.5 cm or less. However the maximum height (or profile difference) that can be successfully traversed will often be larger, and will depend upon choice of components such as wheel size, maximum energy storage capacity and the drive arrangement.

Figure 5A:
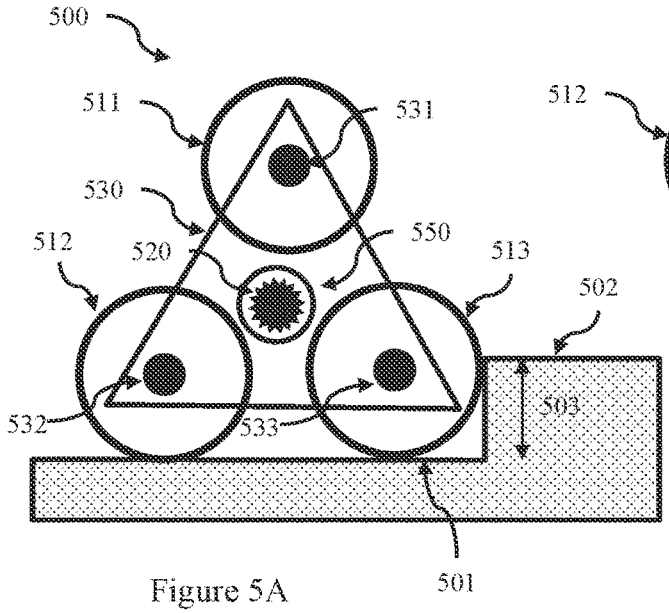
FIG. 5A is a step-climbing wheel apparatus according to an embodiment.
Figure 5B:
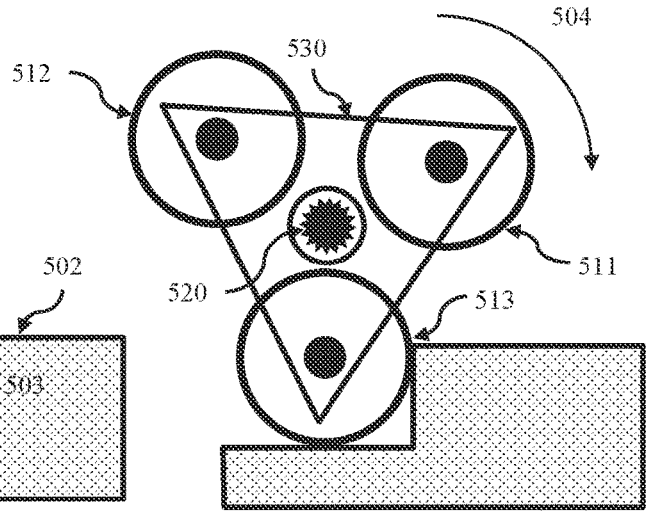
FIG. 5B is the step-climbing wheel apparatus of FIG. 5A in a rotated position.
Figure 5C:
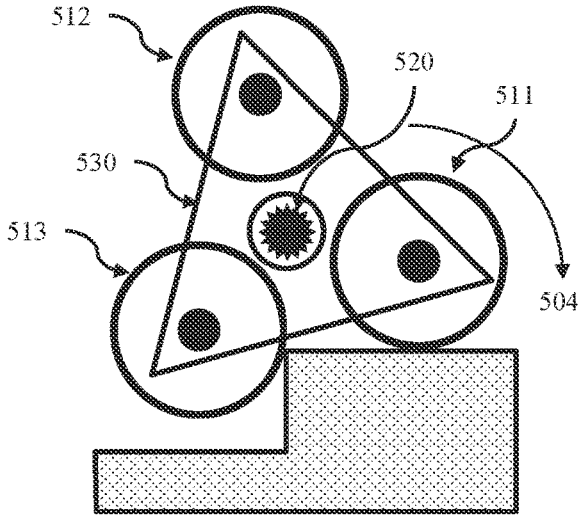
FIG. 5C is the step-climbing wheel apparatus of FIG. 5A in a climbing position.
Figure 5D:
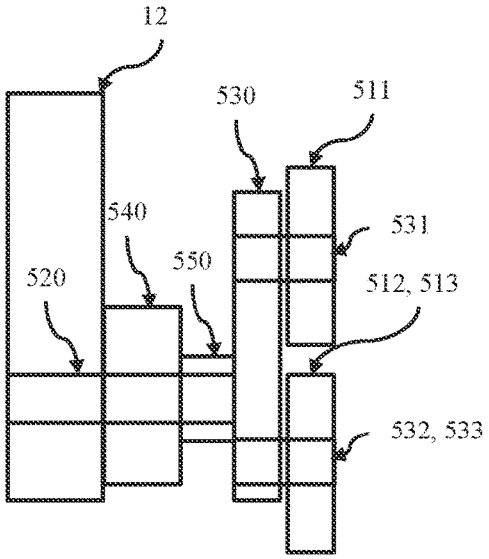
FIG. 5D is a side view of the step-climbing wheel apparatus of FIG. 5A.

FIG. 5A is a step-climbing wheel apparatus (500) on a surface (501) approaching a step (503) to a second surface (502). FIG. 5B is the step-climbing wheel apparatus of FIG. 5A as it rotated forward (504) to climb the step (503) driven by the drive arrangement (550) which forces rotation of the wheel mounting arrangement (530) to move wheel (511) towards the top surface (502). FIG. 5C is the step-climbing wheel apparatus of FIG. 5A after continued forward rotation (504) showing the wheel (511) on the second surface (502). FIG. 5D is a side view of the step-climbing wheel apparatus of FIG. 5A.

The material composition may also be selected to be supportive and comfortable, easily cleaned and resistant to bacterial growth. Additionally the appearance and experience of the person in the chair preferably needs to be comfortable and not confronting so that it is immediately a good user experience. For example, a person with dementia will experience this for the first time every day. In one embodiment the chair is constructed of light but structurally strong materials to ensure the chair is easy to move for an elderly or physically slight (ie small or weak) carer. Additionally the chair is subjected to full shower water flows and is thus the components are sealed or constructed to prevent water ingress. Also as discussed above, many elderly patients suffer from incontinence and/or loose or squirty bowels, and thus the chair may require frequently cleaning with aggressive cleaning agents such as bleach. Thus in one embodiment at least the external surfaces are constructed of non-ferrous corrosion resistant materials such as Aluminium or Titanium alloys), or appropriate (or treated) plastics. Additionally non-ferrous materials which also provide resistance to bacterial growth can be used. In this way the chair can be constructed to be substantially impervious to water ingress and thus meet Ingress Protected (IP) ratings of 65 or more (ie IP65, IP66, IP67, or even IP68) and resistant to aggressive corrosion agents and bacterial growth.

Various materials can be used to construct the chair including corrosion resistant alloys including aluminium alloys and stainless steel, and plastics such as Duratron®. In one embodiment the frame is comprised of structural alloy tube; the paddle is comprised of billet aluminium; the castors are comprised of billet aluminium, nylon, and Duratron T4203 & T4503 P; the rotating assembly is comprised of billet aluminium, Duratron PBI, or cast aluminium; and 316 stainless steel for control items.

Embodiments of the mobile support chair described herein can be used to assist in caring for disabled or infirm people by a carer whom themselves may have a degree of age issue or disability with no or little upper body support, and allows for full access to the person's body without requiring lifting or transferring to a different device. The chair is multi-functional. It can be used as a shower chair for bathing that allows easy operation for the carer, as well as a treatment chair the allows full access to any part of your body with ease and comfort. The chair can be IP rated to allow full shower water flow and to allow it to be easily cleaned. Additionally the chair can be integrated with current transfer technology to assist with moving a patient from their bed to the chair. This enables them to be cared for simply, safely, quickly with one carer at home in their own time rather than having to live in a large supported facility where they have to wait for the availability of staff to assist them. The chair is designed to integrate with a transfer station allowing use with a conveyor bed system, and such transfers are easier and less intrusive compared to other transfer systems such as a hoists and frames. In addition to in-home or independent living applications, the chair can also be used for other patients and applications (eg hospitals, aged care facilities, rehabilitation facilities) and other care functions or treatments. The chair can be converted at any time to a day chair without having to transfer the patient back to the bed to change the chair and then retransfer to the chair. The ability of the chair through rotation and thus the release of weight bearing on each pivotally mounted panels, allow both the seat and the back rest of the chair to be changed. This reduces the amount of transfers required.

Throughout the specification and the claims that follow, unless the context requires otherwise, the words "comprise" and "include" and variations such as "comprising" and "including" will be understood to imply the inclusion of a stated integer or group of integers, but not the exclusion of any other integer or group of integers.

The reference to any prior art in this specification is not, and should not be taken as, an acknowledgement of any form of suggestion that such prior art forms part of the common general knowledge.

It will be appreciated by those skilled in the art that the disclosure is not restricted in its use to the particular application or applications described. Neither is the present disclosure restricted in its preferred embodiment with regard to the particular elements and/or features described or depicted herein. It will be appreciated that the disclosure is not limited to the embodiment or embodiments disclosed, but is capable of numerous rearrangements, modifications and substitutions without departing from the scope as set forth and defined by the following claims.

The invention claimed is:

1. A mobile patient support chair comprising:

a support frame comprising at least four legs each ending in at least one wheel;

a lockable pivot mounting arrangement;

a chair pivotally mounted to the support frame by the lockable pivot mounting arrangement, the chair having an inner side for receiving a patient and an outer side, and the lockable pivot mounting arrangement is configured to lock the chair in a sitting position and a plurality of rotated positions, the plurality of rotated positions comprising at least one forward position rotated with respect to the sitting position, and at least one rearward position rotated with respect to the sitting position, the chair comprising:

a chair frame defining a perimeter of a back portion, a seat portion and a leg portion and;

two arm supports extending inwards from the seat portion of the chair frame;

a head support mounted to the back portion of the chair frame and extending away from the chair frame; and a plurality of support panels mounted to the chair frame, each moveable between a support position and an access position, and lockable at least in the support position, wherein in the support position the support panel supports the patient's body when sitting in the chair, and in the access position the support panel is in a position to provide access to the patient's body adjacent the inner side of the chair.

2. The mobile patient support chair as claimed in claim 1 wherein the chair further comprises:

a plurality of flexible retaining portions removable or retractably attachable to the chair frame, and when attached each flexible retaining portion extends from a first side of the chair frame to a second opposing side of the chair frame for retaining a patient against the inner side of the chair as the chair is rotated and locked in the at least one forward position or the at least one rearward position.

3. The mobile patient support chair as claimed in claim 1 wherein in the support position each of the plurality of support panels is located within a plane defined by either of the back portion, the seat portion, or the leg portion of the frame, or in a foot support position in a plane orthogonal to the plane of the leg portion.

4. The mobile patient support chair as claimed in claim 1 wherein the plurality of support panels are each pivotally mounted to chair frame, and are each rotatable through at least 90 degrees from the support position to the access position.

5. The mobile patient support chair as claimed in claim 1, wherein the plurality of support panels are arranged in a first back group, a second back group, a first seat group, a second seat group, a first leg group, and a second leg group, wherein each of the support panels in the same group are moveable between support positions and access positions as a group.

6. The mobile patient support chair as claimed in claim 1, further comprising a rotation assistance arrangement to control rotation of the chair about the support frame so that a carer is only required to guide the rotation of the chair to and from the sitting position to one of the rotated positions and is not required to use upper body strength to drive a rotational movement.

7. The mobile patient support chair as claimed in claim 1 wherein the chair frame comprises a back frame defining the back portion, a seat frame defining the seat portion and a leg frame defining the leg portion.

8. The mobile patient support chair as claimed in claim 1 wherein the chair frame comprises a foot support comprised of at least two of the plurality of the support panels.

9. The mobile patient support chair as claimed in claim 7, wherein the chair is configured to allow the back frame to be rotated away from the back of the person or to be slid up from a back support position to a patient receiving position to allow transfer of a patient from a bed onto the seat through a space occupied by the back frame when in the back support position.

10. The mobile patient support chair as claimed in claim 1, wherein each leg of the support frame includes a step-climbing wheel apparatus comprising:

a wheel mounting arrangement comprising at least three wheels arranged in a fixed triangular geometry such that when on a flat surface at least one wheel is in contact with the flat surface and at least one wheel is in an elevated position to define a vertical separation distance;

a chair leg mounting arrangement to mount the wheel mounting arrangement to a chair leg;

a drive arrangement which engages the wheel mounting arrangement to assist the mobile patient support chair to climb a step with a height less than the vertical separation distance.

11. The mobile patient support chair as claimed in claim 1, wherein an external surface of the chair is constructed of corrosion resistant material, and is sealed or constructed to prevent water ingress.

12. The mobile patient support chair as claimed in claim 1, wherein each of the panels in the back portion, seat portion and leg portion are separately removable, and replaceable with a solid support section to convert the chair to a day chair.

13. The mobile patient support chair as claimed in claim 1, wherein the lockable pivot mounting arrangement is a clutch arrangement which controls a friction force between a first section attached to the support frame and a second section attached to the chair to control relative motion of the chair with respect to the support frame to allow the chair to be held in any position between a maximum forward position and a maximum rearward position.

14. The mobile patient support chair as claimed in claim 13 wherein either the first section is a fixed section and the second section is a rotating section or the first section is a rotating section and the second section is a fixed section, and the clutch arrangement comprises a friction plate held under pressure by a plurality of springs located between the fixed section and the rotating section to hold the fixed section and rotating section in a fixed relationship, and a cam arrangement is configured to compress the springs and release the friction pressure and allow the rotating section to rotate with respect to the fixed section.

15. The mobile patient support chair as claimed in claim 14, wherein the cam arrangement is controlled by a foot pedal connected by a linkage arrangement passing through a leg of the chair.

16. A mobile patient support system comprising a mobile patient support chair, the system comprising:

a support frame comprising at least four legs each ending in at least one wheel, wherein two of the at least four legs are rearward legs each comprising a laterally extending locking pin;

a lockable pivot mounting arrangement;

a chair pivotally mounted to the support frame by the lockable pivot mounting arrangement, the chair having an inner side for receiving a patient and an outer side, and the lockable pivot mounting arrangement is configured to lock the chair in a sitting position and a plurality of rotated positions, the plurality of rotated positions comprising at least one forward position rotated with respect to the sitting position, and at least one rearward position rotated with respect to the sitting position, the chair comprising:

a chair frame defining a perimeter of a back portion, a seat portion and a leg portion and;

two arm supports extending inwards from the seat portion of the chair frame;

a head support mounted to the back portion of the chair frame and extending away from the chair frame; and a plurality of support panels mounted to the chair frame, each moveable between a support position and an access position, and lockable at least in the support position, wherein in the support position the support panel supports the patient's body when sitting in the chair, and in the access position the support panel is in a position to provide access to the patient's body adjacent the inner side of the chair;

wherein the lockable pivot mounting arrangement is a clutch arrangement which controls a friction force between a first section attached to the support frame and a second section attached to the chair to control relative motion of the chair with respect to the support frame to allow the chair to be held in any position between a maximum forward position and a maximum rearward position, and the first section is a fixed section and the second section is a rotating section or the first section is a rotating section and the second section is a fixed section, and the clutch arrangement comprises a friction plate held under pressure by a plurality of springs located between the fixed section and the rotating section to hold the fixed section and rotating section in a fixed relationship, and a cam arrangement is configured to compress the springs and release the pressure on the friction plate to control the friction force to allow the rotating section to rotate with respect to the fixed section; and one of the rearward legs comprising a coupling connected via a linkage to a worm gear arrangement configured to control a rotation of the rotating section; and a transfer station comprising a first docking assembly, a second docking assembly, and a controller, wherein each of the first docking assembly and the second docking assembly are configured to receive and secure the laterally extending locking pin on the respective rearward leg, wherein one of the first docking assembly or the second docking assembly comprises a planetary gear configured to engage and drive the coupling to control the rotation of the chair with respect to the frame.

17. A mobile patient support system comprising a mobile patient support chair comprising:

a support frame comprising at least four legs each ending in at least one wheel, wherein two of the at least four legs are rearward legs each comprising a laterally extending locking pin;

a lockable pivot mounting arrangement;

a chair pivotally mounted to the support frame by the lockable pivot mounting arrangement, the chair having an inner side for receiving a patient and an outer side, and the lockable pivot mounting arrangement is configured to lock the chair in a sitting position and a plurality of rotated positions, the plurality of rotated positions comprising at least one forward position rotated with respect to the sitting position, and at least one rearward position rotated with respect to the sitting position, the chair comprising:

a chair frame defining a perimeter of a back portion, a seat portion and a leg portion and;

two arm supports extending inwards from the seat portion of the chair frame;

a head support mounted to the back portion of the chair frame and extending away from the chair frame; and a plurality of support panels mounted to the chair frame, each moveable between a support position and an access position, and lockable at least in the support position, wherein in the support position the support panel supports the patient's body when sitting in the chair, and in the access position the support panel is in a position to provide access to the patient's body adjacent the inner side of the chair;

and a transfer station comprising a first docking assembly, a second docking assembly, and a controller, wherein each of the first docking assembly and the second docking assembly are configured to receive and secure the laterally extending locking pin on the respective rearward leg, wherein one of the first docking assembly or the second docking assembly comprises an actuator configured to engage with the lockable pivot mounting arrangement to control a rotation of the chair with respect to the frame to enable transfer of the patient into and out of the chair.

* * * * *